US010746017B2

(12) United States Patent
Zuo et al.

(10) Patent No.: US 10,746,017 B2
(45) Date of Patent: Aug. 18, 2020

(54) RESERVOIR FLUID GEODYNAMIC SYSTEM AND METHOD FOR RESERVOIR CHARACTERIZATION AND MODELING

(71) Applicant: Schlumberger Technology Corporation, Sugar Land, TX (US)

(72) Inventors: Youxiang Zuo, Burnaby (CA); Kang Wang, Beijing (CN); Andrew E. Pomerantz, Lexington, MA (US); Soraya S. Betancourt Pocaterra, Katy, TX (US); Jerimiah Forsythe, Cambridge, MA (US); Cosan Ayan, Istanbul (TR); Hadrien Dumont, Houston, TX (US); Vinay Mishra, Katy, TX (US); Jesus Alberto Canas, Katy, TX (US); Daniel M. Tetzlaff, Houston, TX (US); Anish Kumar, Katy, TX (US); Vladislav Achourov, Stavanger (NO); Thomas Pfeiffer, Lagos (NG); Shu Pan, Edmonton (CA); Yi Chen, Sugar Land, TX (US); Armin Kauerauf, Aachen (DE); Oliver C. Mullins, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 244 days.

(21) Appl. No.: 15/165,798

(22) Filed: May 26, 2016

(65) Prior Publication Data

US 2016/0348480 A1 Dec. 1, 2016

Related U.S. Application Data

(60) Provisional application No. 62/168,379, filed on May 29, 2015, provisional application No. 62/168,404, (Continued)

(51) Int. Cl.
*E21B 49/08* (2006.01)
*E21B 47/10* (2012.01)

(52) U.S. Cl.
CPC ..... *E21B 49/08* (2013.01); *E21B 47/10* (2013.01)

(58) Field of Classification Search
CPC ..... E21B 49/08
See application file for complete search history.

(56) References Cited

U.S. PATENT DOCUMENTS 8,271,248 B2 9/2012 Pomerantz et al.
8,996,346 B2 3/2015 Zuo et al.

(Continued)

OTHER PUBLICATIONS

C.C.J. Scheepens, et al., 3D Modeling using Multiple Scenarios and Realizations for Pre-Reservoir Simulation Screening, SPE 82022 (Year: 2003).*

(Continued)

*Primary Examiner* — Rehana Perveen
*Assistant Examiner* — Steven W Crabb
(74) *Attorney, Agent, or Firm* — Trevor G. Grove

(57) ABSTRACT

A method includes receiving first fluid property data from a first location in a hydrocarbon reservoir and receiving second fluid property data from a second location in the hydrocarbon reservoir. The method includes performing a plurality of realizations of models of the hydrocarbon reservoir according to a respective plurality of one or more plausible dynamic processes to generate one or more respective modeled fluid properties. The method includes selecting the one or more plausible dynamic processes based at least in part on a relationship between the first fluid property data, the second fluid property data, and the modeled fluid properties obtained from the realizations to identify potential disequilibrium in the hydrocarbon reservoir.

13 Claims, 12 Drawing Sheets

Related U.S. Application Data filed on May 29, 2015, provisional application No. 62/208,323, filed on Aug. 21, 2015.

(56) References Cited

U.S. PATENT DOCUMENTS

| | | | | |
|---|---|---|---|---|
| 9,074,460 | B2 | 7/2015 | Pomerantz et al. | |
| 9,416,656 | B2 | 8/2016 | Pomerantz et al. | |
| 9,442,217 | B2 | 9/2016 | Pomerantz et al. | |
| 2010/0132450 | A1* | 6/2010 | Pomerantz | E21B 49/00 73/152.28 |
| 2010/0228485 | A1* | 9/2010 | Betancourt | G01V 11/00 702/13 |
| 2012/0232859 | A1 | 9/2012 | Pomerantz et al. | |
| 2012/0296617 | A1* | 11/2012 | Zuo | E21B 47/10 703/10 |
| 2013/0151159 | A1 | 6/2013 | Pomerantz et al. | |
| 2013/0161502 | A1 | 6/2013 | Pomerantz et al. | |
| 2013/0275099 | A1* | 10/2013 | Frydman | G06F 17/5009 703/2 |
| 2015/0000902 | A1 | 1/2015 | Pomerantz et al. | |
| 2015/0006084 | A1 | 1/2015 | Zuo et al. | |
| 2015/0136962 | A1 | 5/2015 | Pomerantz et al. | |
| 2015/0247941 | A1 | 9/2015 | Fiduk et al. | |
| 2015/0247942 | A1 | 9/2015 | Pomerantz et al. | |

OTHER PUBLICATIONS

Wilson Pastor et al., Measurement and EOS Modeling of Large Compositional Gradients in Heavy Oils, SPWLA 53rd Annual Logging Symposium 2012 (Year: 2012).*

Freed, D. E.; Mullins, O. C.; Zuo, J. Y., Theoretical Treatment of Asphaltene Gradients in the Presence of GOR Gradients. Energy Fuels 2010, 24, 3942-3949.

Freed, D. E.; Mullins, O. C.; Zuo, J. Y., Heuristics for Equilibrium Distributions of Asphaltenes in the Presence of GOR Gradients. Energy Fuels 2014, 28, 4859-4869.

Zuo, J. Y.; Mullins, O. C.; Freed, D.; Elshahawi, H.; Dong, C.; Seifert, D. J., Advances in the Flory-Huggins-Zuo Equation of State for Asphaltene Gradients and Formation Evaluation. Energy Fuels 2013, 27, 1722-1735.

Zuo, J. Y.; Mullins, O. C.; Freed, D.; Zhang, D.; Dong, C.; Zeng, H., Analysis of Downhole Asphaltene Gradients in Oil Reservoirs with a New Bimodal Asphaltene Distribution Function. J. Chem. Eng. Data 2011, 56, 1047-1058.

Pomerantz, A. E., et al., Combining biomarker and bulk compositional gradient analysis to assess reservoir connectivity. Org. Geochem. 2010, 41, 812-821.

Mullins, O. C.; Betancourt, S. S.; Cribbs, M. E.; Dubost, F. X.; Creek, J. L.; Andrews, A. B.; Venkataramanan, L., The Collodial Structure of Crude Oil and the Structure of Oil Reservoirs. Energy Fuels 2007, 21, 2785-2794.

Betancourt, S. S., et al., Nanoaggregates of Asphaltenes in a Reservoir Crude Oil and Reservoir Connectivity. Energy Fuels 2009, 23, 1178-1188.

Dong, C.; Petro, D.; Pomerantz, A. E.; Nelson, R. K.; Latifzai, A. S.; Nouvelle, X.; Zuo, J. Y.; Reddy, C. M.; Mullins, O. C., New thermodynamic modeling of reservoir crude oil. Fuel 2014, 117, 839-850.

Mullins, O. C.; Pomerantz, A. E.; Zuo, J. Y.; Dong, C., Downhole fluid analysis and asphaltene science for petroleum reservoir evaluation. Annual review of chemical and biomolecular engineering 2014, 5, 325-45.

Mullins, O. C., et al., Characterization of Asphaltene Transport over Geologic Time Aids in Explaining the Distribution of Heavy Oils and Solid Hydrocarbons in Reservoirs. In SPE Annual Technical Conference and Exhibition, SPE 170730: Amsterdam, The Netherlands, 2014 (20 pages).

Mullins, O. C., et al., The Dynamics of Reservoir Fluids and Their Substantial Systematic Variations. Petrophysics 2014, 55, 96-112.

Peters, K. E.; Walters, C. C.; Moldowan, J. M., The Biomarker Guide. 2 ed.; Cambridge University Press: Cambridge, 2005; vol. 1. (46 pages).

Pomerantz, A. E.; Seifert, D. J.; Bake, K. D.; Craddock, P. R.; Mullins, O. C.; Kodalen, B. G.; Mitra-Kirtley, S.; Bolin, T. B., Sulfur Chemistry of Asphaltenes from a Highly Compositionally Graded Oil Column. Energy Fuels 2013, 27, 4604-4608.

Pomerantz, A. E.; Seifert, D. J.; Qureshi, A.; Zeybek, M.; Mullins, O. C., The Molecular Composition of Asphaltenes in a Highly Compositionally Graded Column. Petrophysics 2013, 54, 427-238.

Wu, Q.; Seifert, D. J.; Pomerantz, A. E.; Mullins, O. C.; Zare, R. N., Constant Asphaltene Molecular and Nanoaggregate Mass in a Gravitationally Segregated Reservoir. Energy Fuels 2014, 28, 3010-3015.

Zuo, J. Y., et al., Diffusion Model Coupled with the Flory-Huggins-Zuo Equation of State and Yen-Mullins Model Accounts for Large Viscosity and Asphaltene Variations in a Reservoir Undergoing Active Biodegradation. Energy Fuels 2015, 29, 1447-1460.

Zuo, J. Y.; Elshahawi, H.; Mullins, O. C.; Dong, C.; Zhang, D.; Jia, N.; Zhao, H., Asphaltene gradients and tar mat formation in reservoirs under active gas charging. Fluid Phase Equilibria 2012, 315, 91-98.

Zuo, J. Y.; Elshahawi, H.; Dong, C.; Latifzai, A. S.; Zhang, D.; Mullins, O. C., DFA Asphaltene Gradients for Assessing Connectivity in Reservoirs under Active Gas Charging. In SPE Annual Technical Conference and Exhibition SPE 145438: Denver, Colorado, USA, Oct. 30-Nov. 2, 2011. (11 pages).

Mullins, O. C., et al., Advances in Asphaltene Science and the Yen-Mullins Model. Energy Fuels 2012, 26, 3986-4003.

Mander, J.; d'Ablaing, J.; Howie, J.; Wells, K.; Ramazanova, R.; Shepherd, D.; Lee, C., 21st Century Atlantis—Incremental Knowledge from a Staged-Approach to Development, Illustrated by a Complex Deep-Water Field. In New Understanding of the Petroleum Systems of Continental Margins of the World: 32nd Annual, Eds. 2013; vol. 32, pp. 65-95.

Stainforth, J. G., New insights into reservoir filling and mixing processes. In Understanding Petroleum Reservois: Towards an Integrated Reservoir Engineering and Geochemical Approach, Cubitt, J. M.; England, W. A.; Larter, S. R., Eds. Geological Society: London, 2004; vol. 237, pp. 115-132.

* cited by examiner

RESERVOIR FLUID GEODYNAMIC SYSTEM AND METHOD FOR RESERVOIR CHARACTERIZATION AND MODELING

CROSS-REFERENCE TO RELATED APPLICATIONS

This disclosure claims the benefit of and priority to U.S. Provisional Patent Application No. 62/168,379, titled "Reservoir Fluid Geodynamics System and Method," filed May 29, 2015; U.S. Provisional Patent Application No. 62/168,404, titled "Reservoir Characterization System and Method," filed May 29, 2015; and U.S. Provisional Patent Application No. 62/208,323, titled "Systems and Methods for Reservoir Modeling," filed Aug. 21, 2015, which are incorporated by reference herein in their entireties for all purposes.

BACKGROUND

This disclosure relates to determining one or more dynamic processes for a reservoir in a geological formation occurring over geological time and reservoir characterization.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Reservoir fluid analysis may be used to better understand a hydrocarbon reservoir in a geological formation. Indeed, reservoir fluid analysis may be used to measure and model fluid properties within the reservoir to determine a quantity and/or quality of formation fluids—such as liquid and/or gas hydrocarbons, condensates (e.g., gas condensates), formation water, drilling muds, and so forth—that may provide much useful information about the reservoir. This may allow operators to better assess the economic value of the reservoir, obtain reservoir development plans, and identify hydrocarbon production concerns for the reservoir. Numerous possible reservoir models may be used to describe the reservoir. For a given reservoir, however, different possible reservoir models may have varying degrees of accuracy. The accuracy of the reservoir model may impact plans for future well operations, such as enhanced oil recovery, logging operations, and dynamic formation analyses. As such, the more accurate the reservoir model, the greater the likely value of future well operations to the operators producing hydrocarbons from the reservoir.

SUMMARY

This summary is provided to introduce a selection of concepts that are further described below in the detailed description. This summary is not intended to identify key or essential features of the subject matter described herein, nor is it intended to be used as an aid in limiting the scope of the subject matter described herein. Indeed, this disclosure may encompass a variety of aspects that may not be set forth below.

In one example, a method includes receiving first fluid property data from a first location in a hydrocarbon reservoir and receiving second fluid property data from a second location in the hydrocarbon reservoir. The method includes performing a plurality of realizations of models of the hydrocarbon reservoir according to a respective plurality of one or more plausible dynamic processes to generate one or more respective modeled fluid properties. The method includes selecting the one or more plausible dynamic processes based at least in part on a relationship between the first fluid property data, the second fluid property data, and the modeled fluid properties obtained from the realizations to identify potential disequilibrium in the hydrocarbon reservoir.

In another example, a method includes acquiring well logs using a well-logging device in a wellbore in a geological formation, wherein the wellbore or the geological formation, or both, contain a reservoir fluid. The method includes performing downhole fluid analysis using a downhole acquisition tool in the wellbore to determine a plurality of fluid properties associated with the reservoir fluid. The method includes generating a first fluid geodynamic model representative of the plurality of fluid properties based on the downhole fluid analysis. The method includes generating a second fluid geodynamic model based on the first fluid geodynamic model and the well logs.

In another example, a system includes a downhole acquisition tool comprising a plurality of sensors configured to measure fluid properties of a reservoir fluid within a geological formation of a hydrocarbon reservoir. The system includes a data processing system configured to predict one or more dynamic processes from a plurality of dynamic processes that depend at least in part on the measured fluid properties; wherein the data processing system comprises one or more tangible, non-transitory, machine-readable media comprising instructions. The instructions are configured to identify plausible dynamic processes from the plurality of dynamic processes. The instructions are configured to utilize models of the plausible dynamic processes to determine at least one likely realization scenario.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
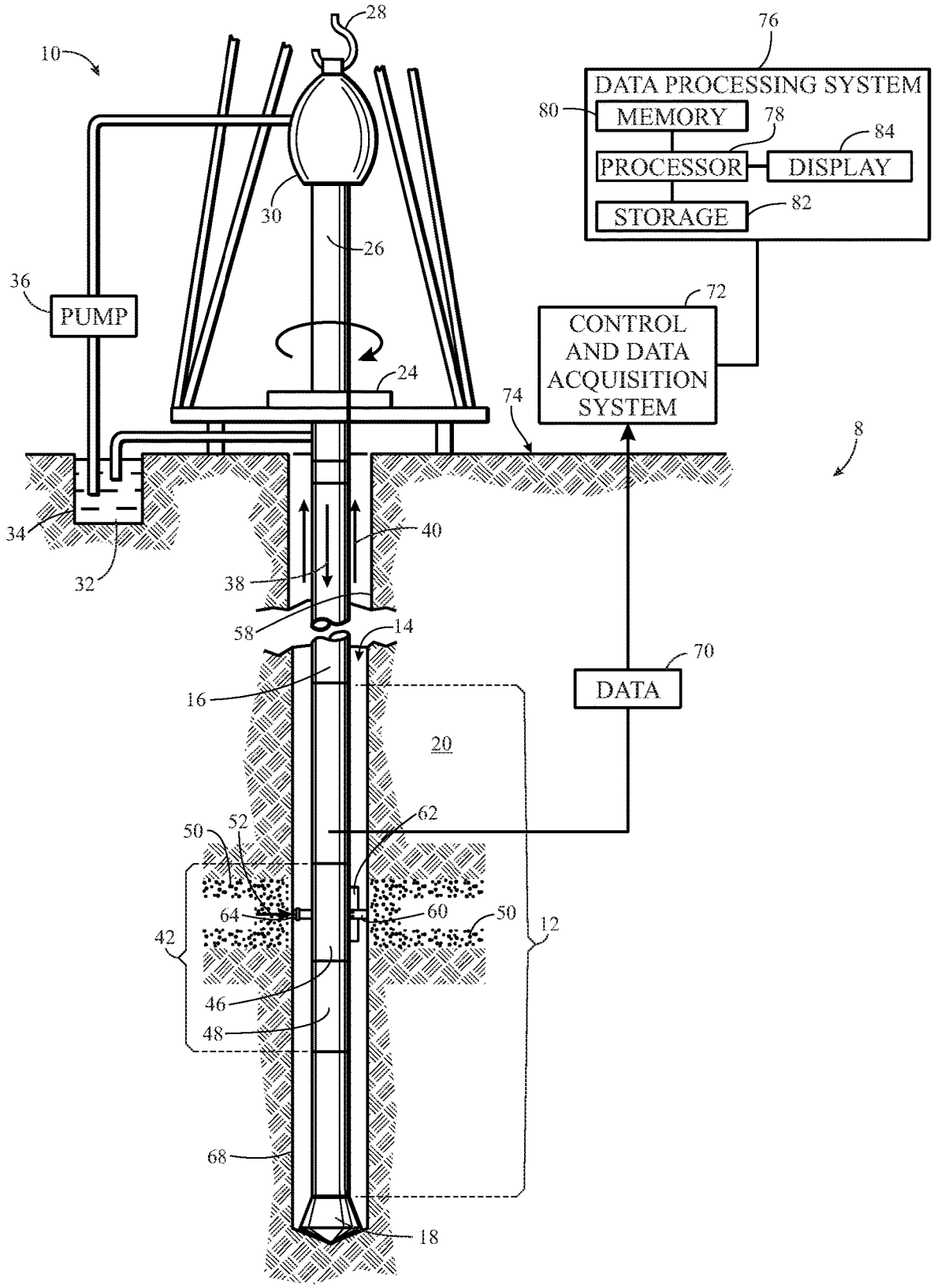
FIG. 1 depicts a rig with a downhole tool suspended therefrom and into a wellbore via a drill string, in accordance with an embodiment of the present techniques.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates to systems and methods for reservoir characterization and reservoir modeling, including identification of particular realization scenarios. Acquisition and analysis representative of formation fluids downhole in delayed or real time may be used in reservoir modeling. A reservoir model based on downhole fluid analysis may predict or explain reservoir characteristics such as, but not limited to, connectivity, productivity, lifecycle stages, type and timing of hydrocarbon, hydrocarbon contamination, reservoir fluid dynamics, composition, and phase. Over the life of the reservoir, reservoir fluids such as oil, gas, condensates may behave dynamically in the reservoir. This may result in spatial variations in the reservoir fluids throughout the reservoir, which may appear as fluid gradients in the composition characteristics of the reservoir fluids. For example, a concentration of compositional components of the reservoir fluid (e.g., gas, condensates, asphaltenes, etc.) may or may not vary along a vertical depth of the reservoir.

Different realization scenarios may be used to model the reservoir. In particular, realizations of equation of state (EOS) models that represent the fluid behavior of the reservoir fluids associated with dynamic processes may be used to predict how a fluid composition gradient may respond to various dynamic processes within the reservoir. Some EOS models are described in U.S. Pat. No. 8,271,248, which is assigned to Schlumberger Technology Corporation and is hereby incorporated by reference in its entirety for all purposes. The EOS model may include cubic equilibrium EOS models, the Flory-Huggins-Zuo (FHZ) equation, and/or dynamic EOS models, which include the FHZ model and a diffusive or convection model associated with the realization scenario (e.g., biodegradation, gas diffusion, convective currents, flow barriers/obstructions, pressure driven oil or gas flow, thermochemical sulfate reduction reactions, etc.). The equilibrium and dynamic EOS models may predict fluid interactions (e.g., gas-to-liquid and solid-to-liquid interactions) and compositions of the reservoir fluids through the reservoir by modeling factors such as, for example, gas-to-oil ratio (GOR), condensate-gas ratio (CGR), density, volumetric factors and compressibility, heat capacity, and saturation pressure.

The reservoir models that may most likely accurately describe the reservoir may be based on certain particular realization scenarios. There may be a wide range of possible realization scenarios, so the most plausible realization scenarios from among these may be selected. For example, by combining measured fluid gradients from the downhole acquisition tool with empirical historical data relating to reservoirs where the realization scenario is known, the more plausible realization scenarios likely to be occurring within the reservoir may be determined. Understanding the dynamic processes affecting a particular reservoir may facilitate reservoir planning development and selecting appropriate enhanced oil recovery techniques to increase reservoir productivity.

It may be appreciated that the reservoir may be further understood with via downhole analysis. Downhole analysis may provide quantitative information of geological boundaries, 3D orientation of strata intersecting a wellbore, faults, fractures, rock composition, fluid content, etc. For example, borehole image logs may be used to provide information associated with the formation geometry and identify zone of interest within the reservoir. Additionally, the borehole image logs may identify sedimentary deposits that may impact reservoir productivity. For example, over the life of the reservoir, sedimentary deposits (e.g., turbidites) may form that may decrease reservoir productivity. For example, certain sedimentary deposits may decrease the permeability of fluid channels within the reservoir, thereby changing the reservoir's connectivity such that the reservoir fluids are unable to flow into wellbores for extraction As discussed above, the spatial variations (e.g., fluid gradients) in a composition of the reservoir fluids may change over time, and may also decrease the reservoir's productivity (e.g., change reservoir connectivity). For example, a concentration of components of the reservoir fluid (e.g., gas, liquid hydrocarbons, asphaltenes, etc.) may vary along a vertical depth of the reservoir. The variation or lack of variation in the concentration of these components may indicate that the reservoir is in disequilibrium or equilibrium. In the case of disequilibrium, the reservoir may be understood to be undergoing—albeit over geologic time—one or more dynamic processes known as realization scenarios. In the case of equilibrium, the reservoir may be understood to have undergone one or more realization scenarios to achieve equilibrium. In either case, the realization scenarios may explain reservoir features that affect reservoir productivity by decreasing reservoir permeability due, in part, to the formation of tar mats and or bitumen deposits within the reservoir. Downhole fluid analysis (DFA) may be used to evaluate fluid behaviors (e.g., by identifying spatial variations) in reservoirs. Data generated from the DFA and/or data from additional sources, may be used to identify the realization scenario that may be causing or have caused fluid gradients or a lack of fluid gradients within the reservoir. By way of example, some realization scenarios that may enable fluid gradients within the reservoir include biodegradation, continuous and/or discontinuous gas diffusion (e.g., gas and/or carbon dioxide ($CO_2$)), fault block migration, subsidence, convective currents, combinations of these, or any other suitable realization scenarios. In essence, the DFA data may be used to shed light on gross-scale reservoir architecture.

This gross-scale reservoir architecture may be further refined with other well logging information. Indeed, the DFA data and/or data from additional sources (e.g., borehole image logs) may be used for reservoir exploration and development, such as, but not limited to, reservoir delineation (e.g., boundaries), connectivity, fluid equilibrium, and identification of dynamic processes affecting reservoir productivity and/or connectivity. The DFA and borehole image logs may be used as inputs for reservoir modeling systems (e.g., geological process models, petroleum systems models, and/or reservoir fluid geodynamics models) to identify the geological setting and fluid distribution of the reservoir, and refine the gross-scale reservoir architecture to generate a fine-scale reservoir architecture. The fine-scale reservoir architecture may provide reservoir details that may not be resolved in the gross-scale reservoir architecture. The DFA and borehole image logs may be compared to reservoir modeling systems (e.g., geological process models, petroleum system models, and/or reservoir fluid geodynamics models) to further constrain geological and reservoir elements for exploration and production of the reservoir. The information generated by analyzing the reservoir architecture may be used to identify areas of low permeability, such as areas containing baffles. As such, operators may increase productivity of a reservoir of interest.

FIG. 1 depicts a rig 10 with a downhole tool 12 suspended therefrom and into a wellbore 14 within a reservoir 8 via a drill string 16. The downhole tool 12 has a drill bit 18 at its lower end thereof that is used to advance the downhole tool 12 into geological formation 20 and form the wellbore 14. The drill string 16 is rotated by a rotary table 24, energized by means not shown, which engages a kelly 26 at the upper end of the drill string 16. The drill string 16 is suspended from a hook 28, attached to a traveling block (also not shown), through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Drilling fluid or mud 32 (e.g., oil base mud (OBM)) is stored in a pit 34 formed at the well site. A pump 36 delivers the drilling fluid 32 to the interior of the drill string 16 via a port in the swivel 30, inducing the drilling mud 32 to flow downwardly through the drill string 16 as indicated by a directional arrow 38. The drilling fluid exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a bottom hole assembly ("BHA"), may be positioned near the drill bit 18 and includes various components with capabilities, such as measuring, processing, and storing information, as well as communicating with the surface. A telemetry device (not shown) also may be provided for communicating with a surface unit (not shown). As should be noted, the downhole acquisition tool 12 may be conveyed on wired drill pipe, a combination of wired drill pipe and wireline, or other suitable types of conveyance.

In certain embodiments, the drilling acquisition tool 12 includes a downhole fluid analysis system. For example, the downhole acquisition tool 12 may include a sampling system 42 including a fluid communication module 46 and a sampling module 48. The modules may be housed in a drill collar for performing various formation evaluation functions, such as pressure testing and fluid sampling, among others. As shown in FIG. 1, the fluid communication module 46 is positioned adjacent the sampling module 48; however the position of the fluid communication module 46, as well as other modules, may vary in other embodiments. Additional devices, such as pumps, gauges, sensor, monitors or other devices usable in downhole sampling and/or testing also may be provided. The additional devices may be incorporated into modules 46, 48 or disposed within separate modules included within the sampling system 42.

The downhole acquisition tool 12 may evaluate fluid properties of reservoir fluid 50. Accordingly, the sampling system 42 may include sensors that may measure fluid properties such as gas-to-oil ratio (GOR), mass density, optical density (OD), asphaltene content, composition of carbon dioxide ($CO_2$), $C_1$, $C_2$, $C_3$, $C_4$, $C_5$, and $C_{6+}$, formation volume factor, viscosity, resistivity, fluorescence, and combinations thereof of the reservoir fluid 50. The fluid communication module 46 includes a probe 60, which may be positioned in a stabilizer blade or rib 62. The probe 60 includes one or more inlets for receiving the formation fluid 52 and one or more flow lines (not shown) extending into the downhole acquisition tool 12 for passing fluids (e.g., the reservoir fluid 50) through the tool. In certain embodiments, the probe 60 may include a single inlet designed to direct the reservoir fluid 50 into a flowline within the downhole acquisition tool 12. Further, in other embodiments, the probe 60 may include multiple inlets that may, for example, be used for focused sampling. In these embodiments, the probe 60 may be connected to a sampling flow line, as well as to guard flow lines. The probe 60 may be movable between extended and retracted positions for selectively engaging the wellbore wall 58 of the wellbore 14 and acquiring fluid samples from the geological formation 20. One or more setting pistons 64 may be provided to assist in positioning the fluid communication device against the wellbore wall 58.

In certain embodiments, the downhole acquisition tool 12 includes a logging while drilling (LWD) module 68. The module 68 includes a radiation source that emits radiation (e.g., gamma rays) into the formation 20 to determine formation properties such as, e.g., lithology, density, formation geometry, reservoir boundaries, among others. The gamma rays interact with the formation through Compton scattering, which may attenuate the gamma rays. Sensors within the module 68 may detect the scattered gamma rays and determine the geological characteristics of the formation 20 based on the attenuated gamma rays.

The sensors within the downhole acquisition tool 12 may collect and transmit data 70 (e.g., log and/or DFA data) associated with the characteristics of the formation 20 and/or the fluid properties and the composition of the reservoir fluid 50 to a control and data acquisition system 72 at surface 74, where the data 70 may be stored and processed in a data processing system 76 of the control and data acquisition system 72.

The data processing system 76 may include a processor 78, memory 80, storage 82, and/or display 84. The memory 80 may include one or more tangible, non-transitory, machine readable media collectively storing one or more sets of instructions for operating the downhole acquisition tool 12, determining formation characteristics (e.g., geometry, connectivity, etc.) calculating and estimating fluid properties of the reservoir fluid 50, modeling the fluid behaviors using, e.g., equation of state models (EOS), and identifying dynamic processes within the reservoir that may be associated with observed fluid behaviors. The memory 80 may store reservoir modeling systems (e.g., geological process models, petroleum systems models, reservoir dynamics models, etc.), mixing rules and models associated with compositional characteristics of the reservoir fluid 50, equation of state (EOS) models for equilibrium and dynamic fluid behaviors, reservoir realization scenarios, (e.g., biodegradation, gas/condensate charge into oil, $CO_2$ charge into oil, fault block migration/subsidence, convective currents, among others), and any other information that may be used to determine geological and fluid characteristics of the formation 20 and reservoir fluid 50, respectively. In certain embodiments, the data processing system 76 may apply filters to remove noise from the data 70.

To process the data 70, the processor 78 may execute instructions stored in the memory 80 and/or storage 82. For example, the instructions may cause the processor to compare the data 70 (e.g., from the logging while drilling and/or downhole fluid analysis) with known reservoir properties estimated using the reservoir modeling systems, use the data 70 as inputs for the reservoir modeling systems, and identify geological and reservoir fluid parameters that may be used for exploration and production of the reservoir. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, reservoir maps, etc.) relating to properties of the well/reservoir as measured by the downhole acquisition tool 12 and plausible realization scenarios associated with the reservoir. It should be appreciated that, although the data processing system 76 is shown by way of example as being located at the surface 74, the data processing system 76 may be located in the downhole acquisition tool 12. In such embodiments, some of the data 70 may be processed and stored downhole (e.g., within the wellbore 14), while some of the data 70 may be sent to the surface 74 (e.g., in real time). In certain embodiments, the data processing system 76 may use information obtained from petroleum system modeling operations, ad hoc assertions from the operator, empirical historical data (e.g., case study reservoir data) in combination with or lieu of the data 70 to determine certain parameters of the reservoir 8.

Figure 2:
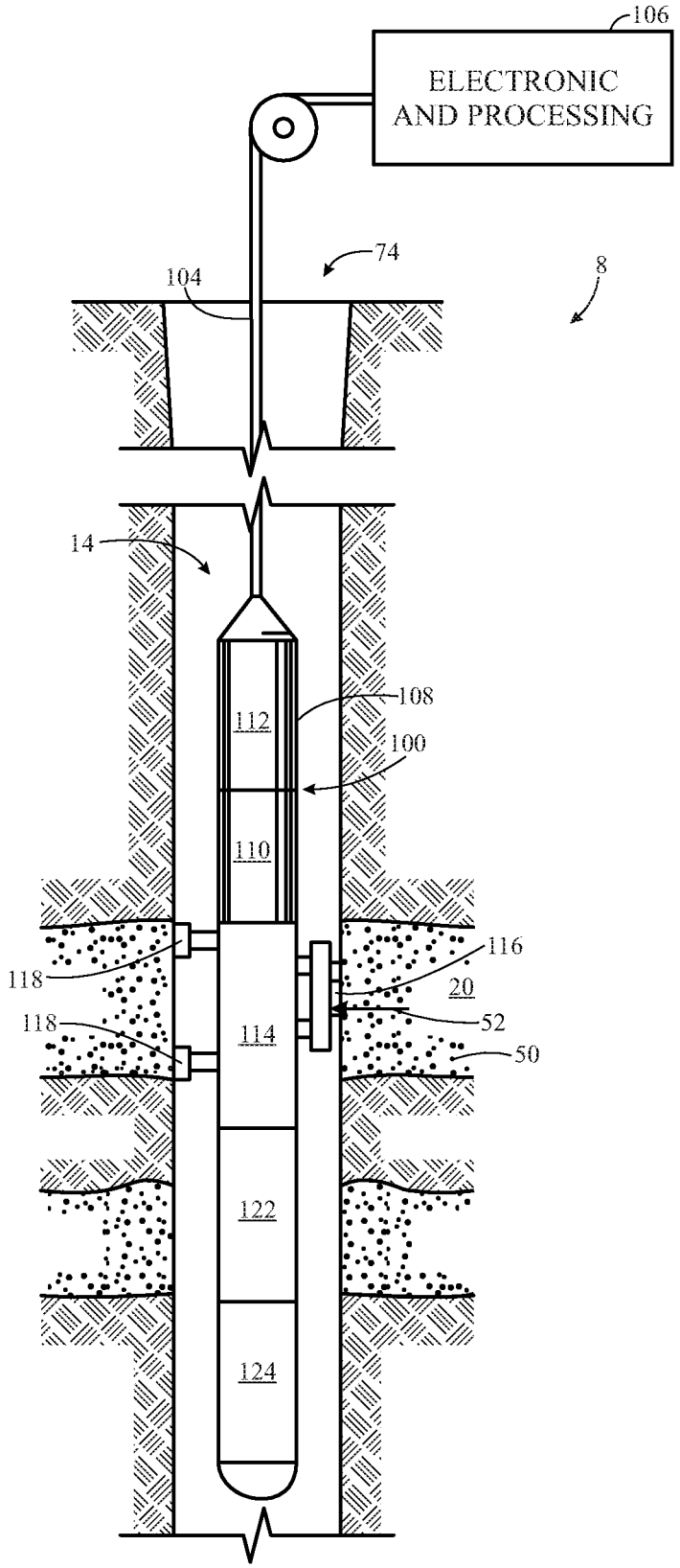
FIG. 2 depicts an example of a wireline downhole tool that may employ the systems and techniques described herein to determine formation and fluid property characteristics of the reservoir, in accordance with an embodiment of the present techniques.

FIG. 2 depicts an example of a wireline downhole tool 100 that may employ the systems and techniques described herein to determine formation and fluid property characteristics of the reservoir 8. The downhole tool 100 is suspended in the wellbore 14 from the lower end of a multi-conductor cable 104 that is spooled on a winch at the surface 74. Similar to the downhole acquisition tool 12, the wireline downhole tool 100 may be conveyed on wired drill pipe, a combination of wired drill pipe and wireline, or other suitable types of conveyance. The cable 104 is communicatively coupled to an electronics and processing system 106. The downhole tool 100 includes an elongated body 108 that houses modules 110, 112, 114, 122, and 124 that provide various functionalities including imaging, fluid sampling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe 116 and backup pistons 118 that are arranged on opposite sides of the elongated body 108. The extendable probe 116 is configured to selectively seal off or isolate selected portions of the wall 58 of the wellbore 14 to fluidly couple to the adjacent geological formation 20 and/or to draw fluid samples from the geological formation 20. The probe 116 may include a single inlet or multiple inlets designed for guarded or focused sampling. The reservoir fluid 50 may be expelled to the wellbore through a port in the body 108 or the formation fluid may be sent to one or more fluid sampling modules 122 and 124. The fluid sampling modules 122 and 124 may include sample chambers that store the reservoir fluid 50. In the illustrated example, the electronics and processing system 106 and/or a downhole control system are configured to control the extendable probe assembly 116 and/or the drawing of a fluid sample from the formation 20 to enable analysis of the fluid properties of the reservoir fluid 50, as discussed above.

Figure 3:
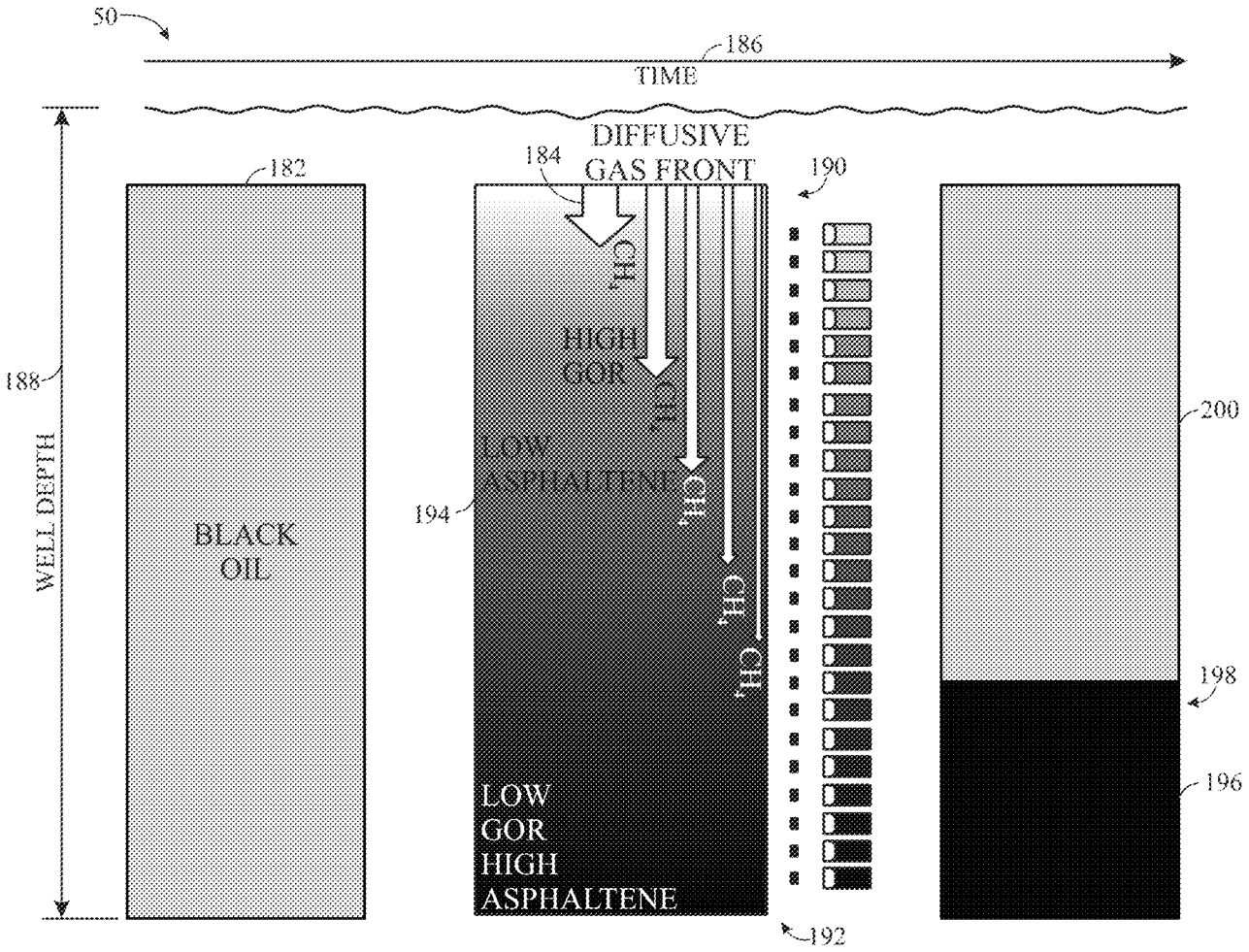
FIG. 3 illustrates an embodiment of a realization scenario that may occur within the reservoir, in accordance with an embodiment of the present techniques.

As discussed above, the data 70 from the downhole tool 10 may be analyzed with the equation of state (EOS) models to determine how gradients in reservoir fluid compositions are affected by various dynamic processes occurring within the reservoir 8. The dynamic processes for the reservoir 8 may include gas/condensate charge, biodegradation, convective currents, fault block migration, and subsidence, among others. FIG. 3 illustrates an embodiment of a realization scenario that may occur within the reservoir 8. Moving from left to right, the diagram in FIG. 3 illustrates the reservoir 8 saturated with immature oil 182 (e.g., black oil) and charged with gas 184 over time 186. The immature oil 182, also known as heavy/black oil, generally has a high concentration of high molecular weight hydrocarbons (e.g., asphaltenes, resins, $C_{60+}$) compared to mature oil (e.g., light oil, gas), which has high concentrations of low molecular weight aliphatic hydrocarbons (e.g., methane ($CH_4$), ethane ($C_2H_6$), propane ($C_3H_8$), $C_4$, $C_5$, $C_{6+}$ etc.). The longer the reservoir fluid (e.g., the reservoir fluid 50) is within the formation 20, certain high molecular weight hydrocarbons found in the immature oil 182 may breakdown into the low molecular weight aliphatic hydrocarbons that make up the mature/light oil. Additionally, over time, source rock (e.g., portion of formation 20 having hydrocarbon reserve) may be buried under several layers of sediment. As the sediment layers increase, a depth 188 of the source rock, reservoir temperature, and reservoir pressure also increase. The increased temperatures and pressures favor the generation of light hydrocarbons which may enter the reservoir.

Figure 4:
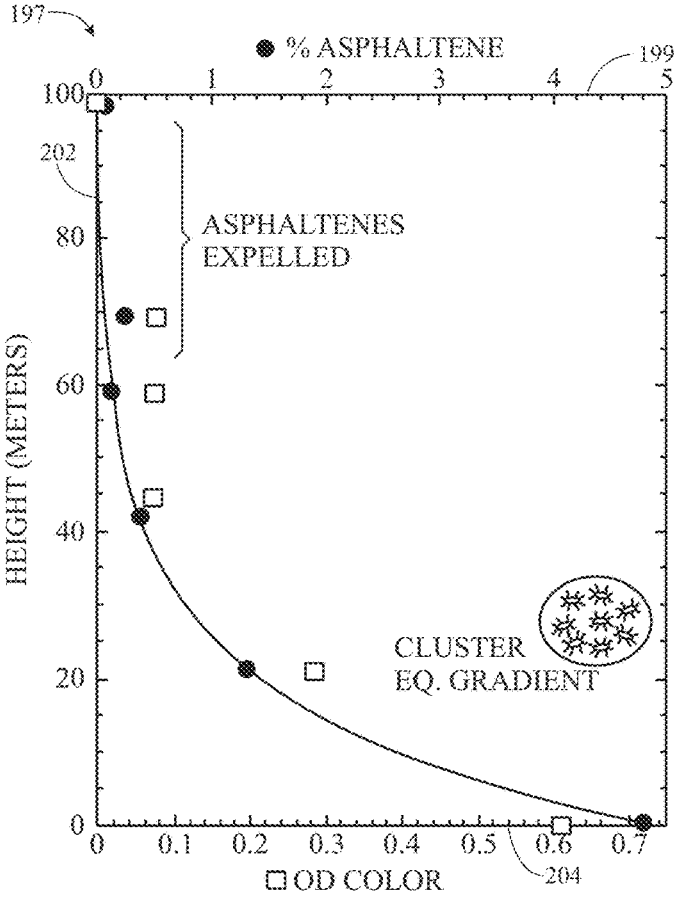
FIG. 4 is an example plot illustrating the asphaltene content as a function of height and optical density, in accordance with an embodiment of the present techniques.

Over time, the low molecular weight aliphatic hydrocarbons (e.g., gas 184) may be expelled from the source rock and travel through a high-permeability streak in the formation to the top of the reservoir unit. As shown in the middle diagram in FIG. 3, the gas 184 diffuses down into the reservoir 8 from top 190 to bottom 192, thereby charging the immature oil 182 with the gas 184. Late charge of gas 184 (e.g., diffusion of gas after the reservoir 8 has been saturated with immature oil) into the immature oil 182 destabilizes the reservoir 8, resulting in a fluid gradient for several fluid properties of the immature oil 182. For example, the late charge of gas 184 may cause fluid gradients in API gravity, gas-to-oil ratio (GOR), saturation pressure (Psat), and combinations thereof of the immature oil 182. As shown in the middle diagram in FIG. 3, a GOR toward the top 190 is higher compared to a GOR toward the bottom 192. In addition, asphaltenes 194 are generally insoluble in the gas 184. Therefore, increased concentration of the gas 184 toward the top 190 of the reservoir 8 may cause the asphaltenes 194 to phase separate. Alternatively, the asphaltenes 194 may diffuse ahead of the gas front, and flow towards the bottom 192 (e.g., when the asphaltenes do not phase separate). Diffusion of the asphaltenes 194 ahead of the gas front may yield mass density inversions and gravity currents (convective currents), which may result in bitumen deposition upstructure and/or tar mats 196 at the bottom 192 of the reservoir 8. For example, a flow of asphaltenes 194 to the bottom 192 may lead to a low concentration of asphaltenes 194 toward the top 190 compared to a concentration of asphaltenes 194 toward the bottom 192, resulting in a concentration gradient for the asphaltenes 194 in the reservoir 8. FIG. 4 is an example plot 197 illustrating the asphaltene content 199 (% wt asphaltene), which is proportional to optical density 204, as a function of height 202 (e.g., the depth) in meters (m). As illustrated, the asphaltene concentration increases with increasing depth (decreasing height) as a result of the diffusion of the gas 184.

As such, the asphaltenes 194 may accumulate at an oil-water-contact (OWC) 198, thereby forming the tar mat 196, as shown in the far right diagram in FIG. 3. Once diffusion of the gas 184 is near complete, fluid 200 above the tar mat 196 may be stabilized. As should be appreciated, the fluid 200 may have a high GOR and low asphaltene concentration compared to the immature fluid 182. The tar mat 196 may decrease porosity and permeability of the formation.

Figure 5:
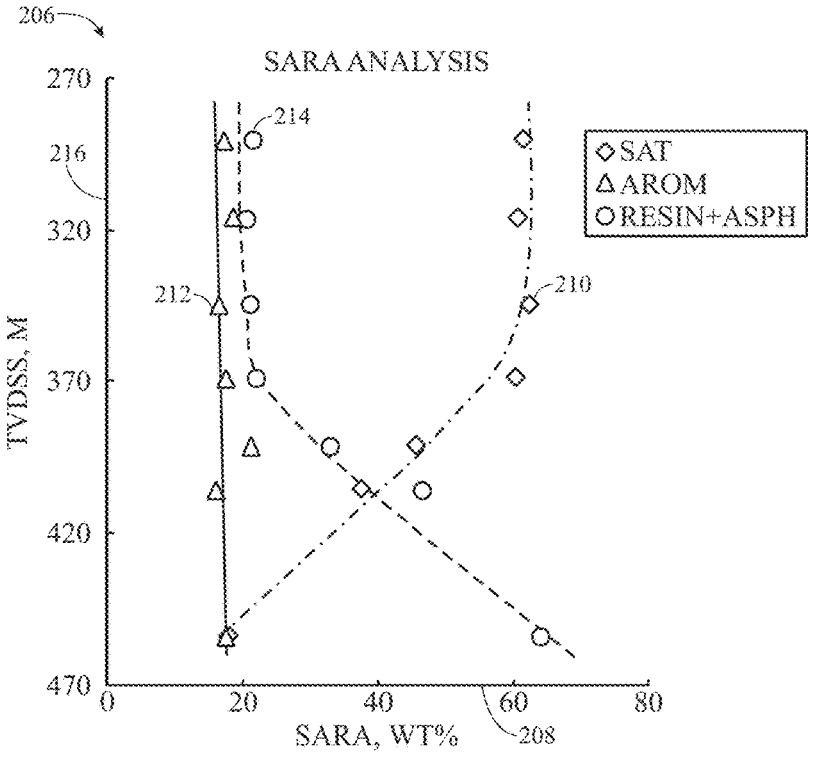
FIG. 5 is a saturates, aromatic, resin, aromatics analysis example plot illustrating a concentration of saturates, aromatics, and asphaltenes-resin as a function of true vertical depth subsea (TVDSS) in meters, in accordance with an embodiment of the present techniques.

Similarly, realization scenarios associated with biodegradation of hydrocarbons at the OWC 198 may increase a concentration of the asphaltenes 194 toward the bottom 192 of the reservoir 8. FIG. 5 is a SARA (saturates, aromatic, resin, aromatics) analysis example plot 206 illustrating a % concentration 208 of saturates 210, aromatics 212, and asphaltenes-resin 214 as a function of true vertical depth subsea (TVDSS) 216 in meters. As illustrated, the concentration of saturates 210 decreases as a depth (e.g., depth) of the reservoir increases. Conversely, a concentration of the asphaltene-resin 214 may increase with increasing depth. This may be indicative of biodegradation of the immature oil 182 at the OWC 198. Biodegradation of the immature oil 182 may result in a viscosity gradient along the depth and enable formation of the tar mat 196. As such, the reservoir fluid 50 in the formation 20 may be difficult to extract, decreasing reservoir productivity. Therefore, it may be advantageous to identify the biodegradation and location of the tar mat (e.g., relative to a true vertical depth of the wellbore) occurring within the reservoir such that appropriate treatment techniques may be used to mitigate the effects of the dynamic process and increase reservoir productivity. In addition, by knowing the type and location of the dynamic processes occurring within the reservoir 8, dynamic formation analyses may be customized for development of the reservoir 8 and any other reservoirs having similar dynamic processes.

Figure 6:
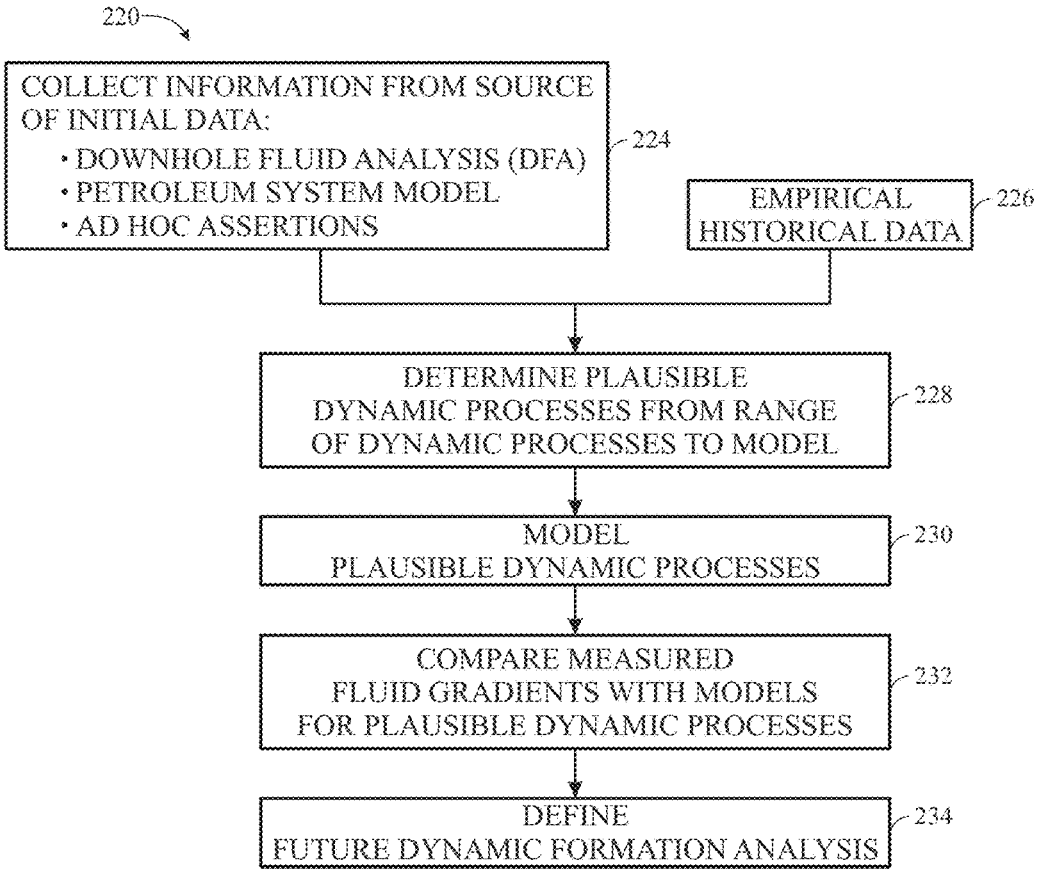
FIG. 6 illustrates a method for identifying dynamic processes within the reservoir, in accordance with an embodiment of the present techniques.

A method for identifying dynamic processes for hydrocarbon reservoirs (e.g., the reservoir 8) is illustrated in flowchart 220 of FIG. 6. For example, in the illustrated flowchart 220, information from sources of initial data may be collected (block 224). The sources of the initial data may include the data 70 from the downhole fluid analysis (DFA), data from petroleum systems modeling (PSM), estimates based on prior knowledge of the trap filling process, ad hoc assertions from operators, seismic data, logging data, or any other suitable source of information associated with the reservoir 8, in addition to the data obtained according to block 224. The method 220 also includes obtaining empirical historical data (e.g., case study data) generated over time from the reservoir 8 and/or other reservoirs (block 226). The empirical historical data 226 may include well logs, downhole fluid analysis, laboratory data, etc. from reservoirs (e.g., a second hydrocarbon reservoir) having similar characteristics to those observed in the reservoir 8 (e.g., a first hydrocarbon reservoir). The empirical historical data 226 may provide information with respect to fluid behavior patterns associated with different realization scenarios. The fluid behavior patterns from the empirical historical data 226, in combination with the initial data 224 (e.g., initial DFA data), may facilitate selecting the realization scenario(s) likely to be occurring or that have occurred with the reservoir 8.

Reservoirs having fluid behaviors similar to the reservoir 8 may have similar behaviors due to similar dynamic processes. As such, the data 70 may be compared to fluid behavior information that may be obtained from PSM of the reservoir 8, the operator, and/or empirical historical data 226 to identify plausible dynamic processes for the reservoir 8 from among a range of possible dynamic processes (block 228). Indeed, as discussed above, the data 70 from the DFA may provide information regarding the gas-to-oil ratio (GOR), viscosity, density, and/or composition (e.g., asphaltene content) of the reservoir fluid at different depths (e.g., the depth) of the reservoir 8. Any changes in the measured data 70 and/or reservoir productivity from the routine sequence and behavior may indicate to the operator that the reservoir 8 may be in disequilibrium and/or one or more dynamic processes have occurred or are currently occurring. The DFA information generated from the data 70 may identify one or more gradients (e.g., viscosity gradients, density gradients, GOR gradients, asphaltene concentration gradients, etc.) in the reservoir fluid that may be associated with one or more dynamic processes (e.g., one of the dynamic processes discussed above with reference to FIGS. 3-5). This information may be compared to the empirical historical data from block 226 to determine one or more plausible scenarios from the range of dynamic processes (block 228) that may be causing the one or more gradients.

Following identification of the plausible dynamic processes based on the initial data 224 and empirical historical data 226, the method 220 includes modeling the one or more plausible realization scenarios associated with those dynamic processes (block 230). Each plausible realization scenario from the one or more plausible realization scenarios, identified according to block 228, may be modeled using the respective equilibrium and/or dynamic equation of state (EOS) models. By way of example, if biodegradation was identified as one of the plausible dynamic processes, the equilibrium and dynamic EOS model for biodegradation is used to model the realization scenario. Having identified the one or more plausible realization scenarios according to block 228 may increase the robustness of the method 220 compared to modeling each dynamic process from the range of dynamic processes that may or may not be affecting the reservoir 8.

The method also includes comparing the measured fluid gradients (e.g., obtained from the data 70) with the EOS models for the one or more plausible realization scenarios (block 232). By comparing (e.g., fitting) the measured fluid gradients and the EOS models, the method disclosed herein may determine if the reservoir 8 is in equilibrium or disequilibrium, and may predict the one or more dynamic processes causing the gradients based on the realization scenario EOS model that fits the data 70. For example, if the measured fluid gradient fits the equilibrium EOS, the data processing system 76 may determine that the reservoir 8 is in equilibrium. Conversely, if the measured fluid gradient does not fit the dynamic EOS, the data processing system 76 may determine that the reservoir 8 is in disequilibrium. Similarly, if the measured fluid gradient fits the EOS model for a respective realization scenario (e.g., gas diffusion, biodegradation, pressure driven oil or gas flow, thermochemical sulfate reduction reactions, etc.), the data processing system 76 may predict that the observed fluid gradient is a result of the realization scenario associated with that particular EOS model. As should be noted, the EOS models may be compared to data from other sources. For example, the EOS models may be compared to the petroleum system models for the reservoir 8, ad hoc assertions from the operator, or combinations thereof.

In certain embodiments, the one or more dynamic processes identified as likely for the reservoir 8 may be validated via geochemical analyses. The geochemical analyses may include measuring biomarker ratios known to be sensitive to identified dynamic processes. The biomarker ratios may be measured with single- or multi-dimensional gas chromatography or any other suitable analytical technique. Additionally, the geochemical analysis may include measuring asphaltene composition, which may also be used to determine certain parameters in the equation of state (EOS) models.

The combination of the data 70 from the downhole fluid analysis (DFA) and the EOS models may also provide information as to where in the reservoir 8 certain events associated with the identified one or more dynamic processes are located. For example, the depth at which the measured asphaltene content (e.g., determined via DFA) of the reservoir fluid 50 increases more than predicted by the equilibrium EOS may be the depth at which the viscosity of the reservoir fluid 50 increases precipitously, and the location where biodegradation is likely occurring. Similarly, gas diffusion (e.g., continuous or discontinuous) may result in various fluid gradients (e.g., GOR, bubble point, API gravity, and asphaltene onset pressure) that may affect reservoir productivity. The location of the gas diffusion may be located at depths where the gas content (e.g., GOR determined from DFA) is higher and the asphaltene content (e.g., measured using DFA) is lower than predicted by the equilibrium EOS. As described in further detail below, knowing the location of the events (e.g., dynamic processes) may facilitate oil recovery and reservoir production operations.

Figure 7:
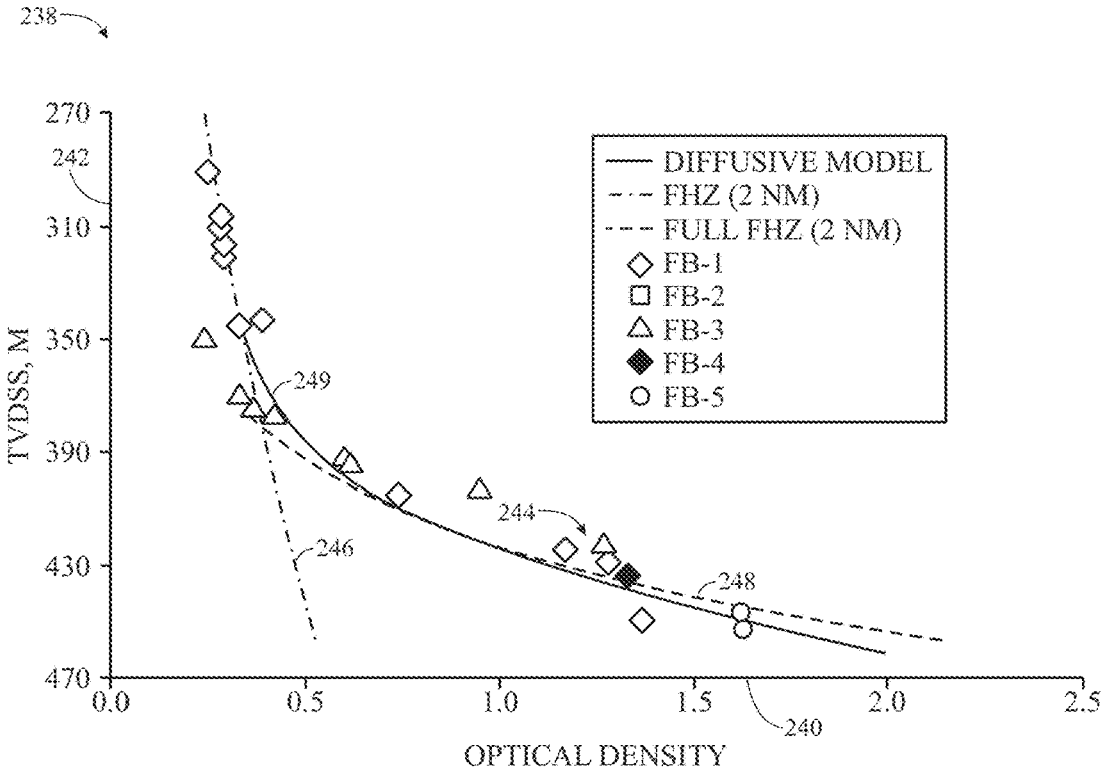
FIG. 7 is a representative plot of an example reservoir illustrating the optical density of a reservoir fluid in the example reservoir as a function of true vertical depth subsea (TVDSS) for multiple fluid beds within the example reservoir, in accordance with an embodiment of the present techniques.

FIG. 7 is a representative plot 238 of an example reservoir illustrating the optical density 240 of a reservoir fluid in the example reservoir as a function of true vertical depth subsea (TVDSS) 242 in meters (m) for multiple fluid beds (e.g., FB-1, FB-2, FB-3, FB-4, and FB-5) within the example reservoir. In the illustrated embodiment, measured data 244 (e.g., DFA data) for each fluid bed 1-5 was compared to the equilibrium equation of state (EOS) model 246, dynamic EOS model 248, and diffusive model 249 for a biodegradation realization scenario. As illustrated, the measured data 244 does not match/fit the equilibrium EOS model 246. However, the dynamic EOS 248 and the diffusive model 249 fit the measured data 244. Accordingly, based on the analysis illustrated in plot 238, the reservoir associated with the fluid beds 1-5 is not in equilibrium. Moreover, the observed fluid gradient fits the dynamic EOS model for biodegradation. Therefore, the dynamic process causing the observed fluid gradient is biodegradation. As discussed above, the dynamic EOS 248 is a combination of the equilibrium EOS and the diffusive model 249.

Figure 8:
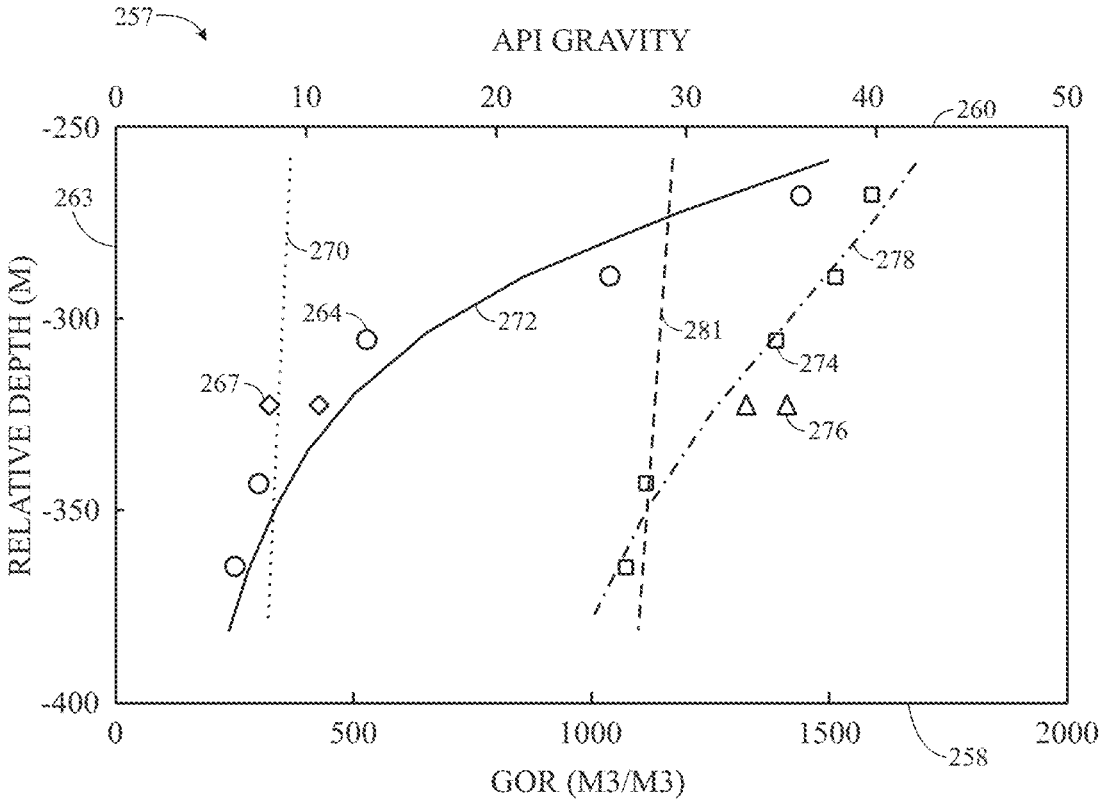
FIG. 8 is another representative plot of an example reservoir illustrating gas-to-ratio (GOR) and API gravity as a function of relative depth in meters for a reservoir undergoing gas diffusion, in accordance with an embodiment of the present techniques.

FIG. 8 is another representative plot 257 of an example reservoir illustrating gas-to-ratio (GOR) 258 and API gravity 260 as a function of relative depth 263 in meters for a reservoir undergoing gas diffusion, as described above with reference to FIG. 3. As shown, DFA GOR data 264 and production GOR data 267 do not fit the equilibrium EOS model 270 for gas diffusion, but do fit the dynamic EOS model 272 which includes gas diffusion. As such, the dynamic process occurring in this particular reservoir is gas diffusion. Similarly, lab API gravity 274 and production API gravity data 276 fit dynamic EOS model 278, and do not fit the equilibrium EOS 281. Therefore, this particular reservoir is undergoing gas diffusion.

Returning to the method of FIG. 6, once the one or more realization scenarios for the measured fluid gradients have been determined, the information obtained from the acts of blocks 224, 226, 228, 230, and 232 may be used define future dynamic formation analysis (block 234). Information associated with the type and location of the realization scenario may be used as input parameters for the dynamic formation analysis. The dynamic formation analysis may then be used to investigate future logging campaigns, models in reservoir simulators, and petroleum system modeling. Additionally, the identified dynamic processes may suggest potential issues, and the location of the potential issues, within the reservoir 8 that may impact reservoir productivity. As such, an operator may plan where and how to implement reservoir drilling operations that may recover a desirable amount of hydrocarbons (e.g., the reservoir fluid) from the reservoir 8, and plan surface facility design. Moreover, the dynamic processes predicted, according to block 232, may be used to determine enhanced oil recovery (EOR) techniques to increase productivity of the reservoir 8 that may be affected by the realization scenario. For example, in the case of gas diffusion, an operator may manage the gas diffusion by keeping fluid pressure above a saturation pressure of the gas, which may vary at different locations in the reservoir due to the influence of the gas diffusion. The operator may also design the facilities at surface to accommodate the volume of gas that may be produced as a result of the gas diffusion. If the dynamic processes indicates the presence of bitumen deposits upstructure, the operator may use organic scale treatments (e.g., xylene washes) to improve the reservoir productivity during reservoir development operations and/or EOR. Therefore, the data processing system 76 may use the information generated from the acts of the method 220 to predict the dynamic processes occurring within the reservoir 8 and identify potential issues, and their location, that may impact reservoir productivity for wellbores within the reservoir 8 and/or other reservoirs having fluid behaviors similar to that of reservoir 8.

The predicted dynamic processes within the reservoir 8 may be used to plan logging measurements that are used to characterize reservoirs and mitigate potential problems that may be associated with the reservoirs. By way of example, the information obtained from the predicted dynamic processes may provide information as to where potential problems may occur within the reservoir 8. As such, the operator may plan where in the reservoir 8 logging measurements are acquired. The logging measurements may also be used to validate the prediction of the dynamic process. For example, the logging measurements may be fitted to the predicted models employing varying realization scenarios. In certain embodiments, lab data for the reservoir 8 may be compared to the predicted realization scenario to validate and determine the accuracy of the predicted realization scenario generated from the acts of the method 220. Furthermore, the dynamic EOS models for the predicted realization scenarios may be used in the formation analyses to collect data from other reservoirs and/or wellbores within the reservoir 8 in a way that may increase the accuracy of the realization scenarios identified.

As discussed above, reservoir fluid geodynamics may be used to model dynamic fluid behaviors, and provide accurate and reliable information associated with hydrocarbon timing (e.g., age), type (e.g., light oil, heavy oil), fluid distributions (e.g., gradients), and volume of the reservoir fluid. This information may be used to identify and locate realization scenarios (e.g., dynamic processes) within a reservoir that may affect reservoir productivity. By knowing the dynamic processes affecting the reservoir productivity, operators may determine which enhance oil recovery (EOR) techniques may increase reservoir productivity rather, than choosing the EOR based on, for example, trial and error. Moreover, the information from the predicted realization scenarios may be used to develop future formation analyses for reservoir characterization, thereby decreasing costs generally associated with extensive formation analyses.

It may be appreciated the above techniques relating to identification and locating of realization scenarios affecting the reservoir 8 and its productivity may be utilized with logging and DFA information to provide an understanding of the architecture of the elements of the reservoir 8.

Figure 9:
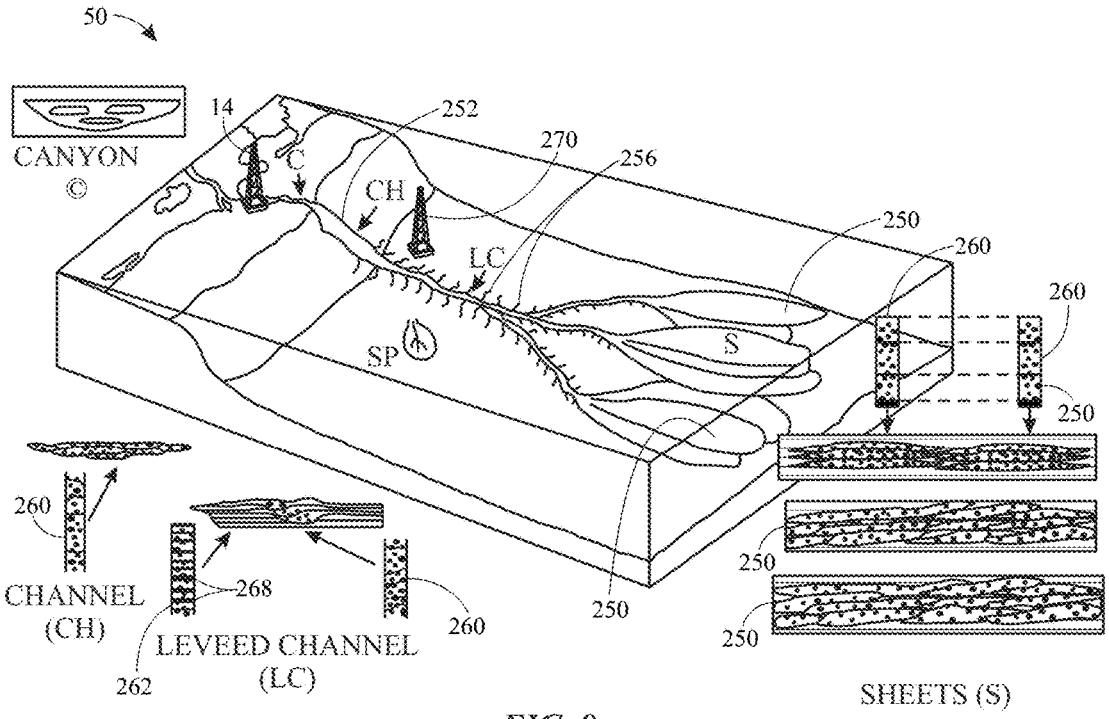
FIG. 9 illustrates a diagram of architectural elements of the reservoir, in accordance with an embodiment of the present techniques.

FIG. 9 illustrates a diagram of architectural elements of the reservoir 8. The reservoir 8 includes a plurality of sheets (S) 250 and a channel (Ch) 252. Each sheet of the plurality of sheets 250 include layers of hydrocarbons (e.g., the reservoir fluid 50) that may feed through the channel 252, and extracted through one or more wellbores 14. The plurality of sheets 250 has a moderate to high lateral reservoir correlation relative to the channels 252. If the plurality of sheets 250 is amalgamated, vertical connectivity is probable. However, if the plurality of sheets 250 is layered, there may be a low probability of vertical connectivity. The channel 252 may have a lateral reservoir correlation that is poor relative to the plurality of sheets 250. If the channel 252 has amalgamated thick sands, there is a moderate probability of vertical continuity and low probability of lateral continuity. The reservoir 8 may also include leveed channels (LC) 256 extending from the main channel 152. Depending on the properties of the formation 20, the leveed channels 256 may have sedimentary deposits that may impact the productivity of the wellbore 14. For example, in deepwater system, sedimentary deposits may include turbidites. The turbidites may decrease formation permeability, and decrease a flow of the reservoir fluid 50 through the leveed channel 256 compared to a flow of the reservoir fluid 50 through a channel that does not have turbidites. The leveed channel 256 may have a lateral reservoir correlation that is moderate to poor compared to the plurality of sheets 250, and the probability of a continuous reservoir that is vertical and/or lateral is low.

Borehole log (e.g., imaging, resistivity, etc.) and downhole fluid analysis (DFA) data (e.g., the data 70) obtained from the downhole acquisition tool 12 may facilitate characterization of the permeability and geometric characteristics (e.g., lateral reservoir correlations and continuity) of the sheets 150 and channels 152, 156. In addition, the logs and DFA data may provide information associated with the connectivity of the sheets 150 (e.g., whether all the sheets 150 feed into a single or multiple channels 152) and location of the leveed channels 156. This information may be used to model the reservoir 8, and facilitate planning and developing the reservoir 8 (e.g., determine location of the wellbores 14 within the reservoir).

For example, based on the borehole logs and DFA, hydrocarbon permeable regions 260 and hydrocarbon non-permeable regions 262 within the reservoir 8 may be identified with increased accuracy compared to techniques that do not use DFA. Knowing where in the reservoir 8 permeable and non-permeable regions 260, 262, respectively, are located, the operator may determine optimal locations for additional wellbores 14 within the reservoir to maximized extraction of the reservoir fluid 50. As discussed above, the leveed channels 256 may have sedimentary deposits 268 (e.g., turbidites). The sedimentary deposits 268 may form the non-permeable regions 262, thereby decreasing the productivity of a wellbore receiving the reservoir fluid 50 from the leveed channels 256, rather, than from the sheets 250 and the main channel 252.

Figure 10:
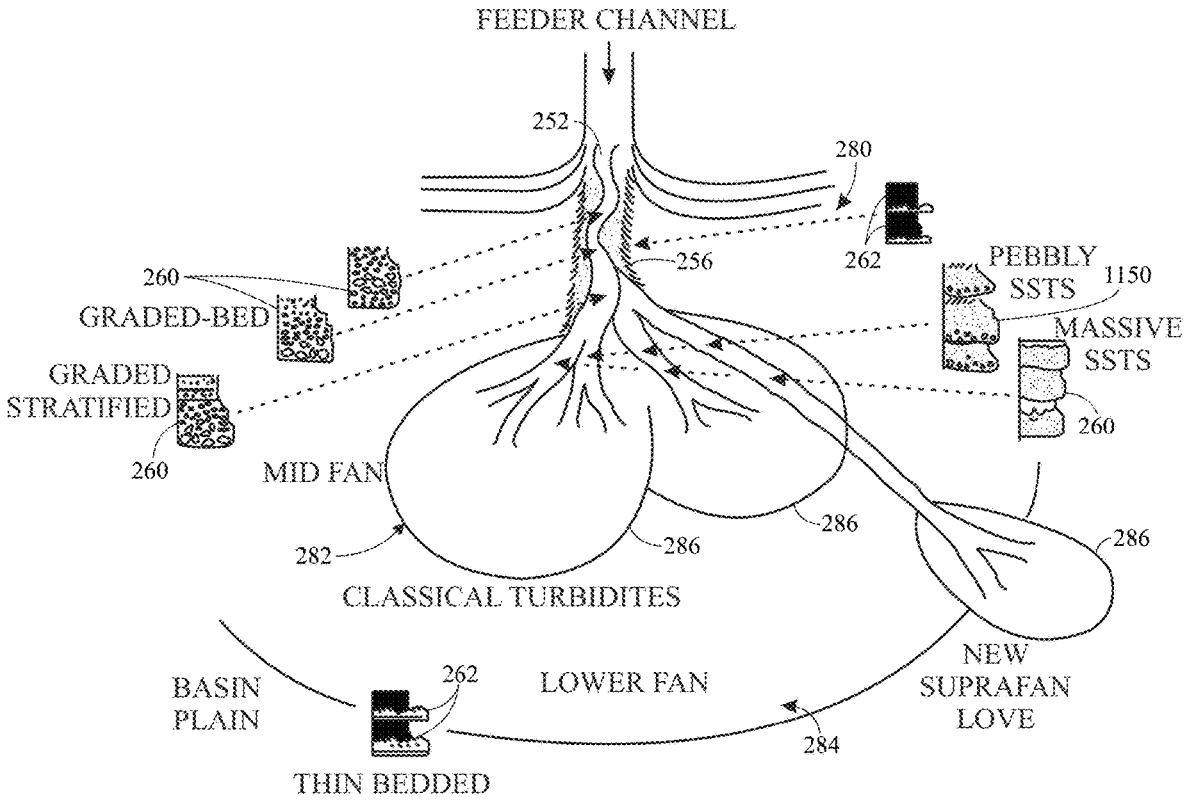
FIG. 10 illustrates a fan model of sedimentary deposits within a reservoir, such as the reservoir, in accordance with an embodiment of the present techniques.

FIG. 10 illustrates a fan model of sedimentary deposits within a reservoir, such as the reservoir 8. As illustrated, the reservoir 8 may have various sedimentary deposits that form fans 280, 282, 284 in the reservoir 8. Each fan 280, 282, 284 may have both permeable and non-permeable regions 1150, 262. For example, in the illustrated embodiments, the lower fan 184 has turbidite deposits and forms the non-permeable region 262. Similarly, the upper fan 280 includes the leveed channels 256 and the non-permeable region 262. However, upper fan 280 also includes permeable regions 260 along the main channel 252. The main channel 252 may also branch out into multiple lobe that contain the reservoir fluid 50. As discussed in further detail below, the log and DFA data 70 from the downhole acquisition tool 12 may identify the location of the main channel 252, leveed channels 256, regions 260, 262, and lobes 286 to facilitate reservoir planning and development.

Figure 11:
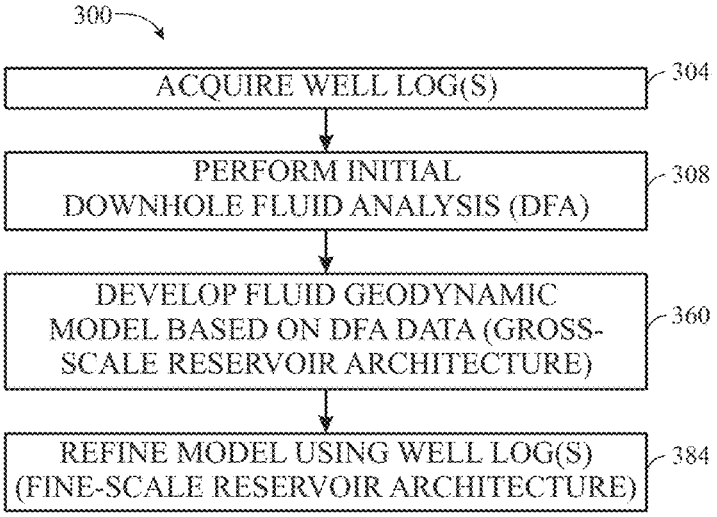
FIG. 11 is a flow diagram of a method that may be used to characterize relevant components of the reservoir that may provide information as to the three dimensional structure of the reservoir, in accordance with an embodiment of the present techniques.

FIG. 11 is a flow diagram of a method 300 that may be used to characterize relevant components (e.g., channels 252, 254, regions 260, 262, lobes 286, etc.) of the reservoir 8 that may provide information as to the three dimensional structure of the reservoir 8, and identify depositional and/or sedimentary environments (e.g., eolian, fluvial, deltaic, deepwater, longshore bars, tidal, and reefs) within the reservoir 8.

As discussed above, the data 70 from the downhole tool 10 may be analyzed with the equation of state (EOS) models to determine how gradients in reservoir fluid compositions respond to various dynamic processes (e.g., realization scenarios) occurring within the reservoir 8. The method 300 includes acquiring well logs (block 304) of the reservoir 8 using the downhole acquisition tool 12. The well logs may provide information about the geological boundaries (e.g., where the reservoir starts and ends), three dimensional orientation of strata intersecting the wellbore 14, faults, fractures in the formation 20, rock composition and texture, fluid content (e.g., presence of water and/or liquid/gas hydrocarbon), geological facies classifications (e.g., sedimentary, metamorphic, shale facies, channel sand, levee, marine siltstone, etc.), and identification of depositional environments. In addition to the well logs, the downhole acquisition tool 12 may determine pressure and temperature parameters of the reservoir 8. The downhole acquisition tool 12 may collect data from various stations along a depth of the wellbore 14.

Following well log acquisition according to the acts of block 304, the method 300 includes performing an initial downhole fluid analysis (DFA) (block 308). The DFA analysis may provide information associated with a state of fluid equilibrium (e.g., whether the fluid is in equilibrium or non-equilibrium (e.g., undergoing a dynamic process)) and/or the connectivity of the reservoir.

It may be appreciated that realization scenarios associated with biodegradation of hydrocarbons at the OWC 198 may increase a concentration of the asphaltenes 194 toward the bottom 192 of the reservoir 8. The increased concentration of asphaltenes 194 at the bottom 192 may result in a viscosity gradient in the immature oil 182 along the depth 188 and enable formation of the tar mat 196. As such, the reservoir fluid 50 in the formation 20 may be difficult to extract, decreasing reservoir productivity. Therefore, it may be advantageous to identify the dynamic process causing the gradient within the reservoir, and determine where in the reservoir (e.g., along the depth) the dynamic processes are occurring such that appropriate treatment techniques may be used to mitigate the effects of the dynamic processes and increase reservoir productivity. In addition, by knowing the type and location of the dynamic processes occurring within the reservoir, dynamic formation analyses may be customized for development of the reservoir 8 and any other reservoirs having similar realization scenarios.

Figure 12:
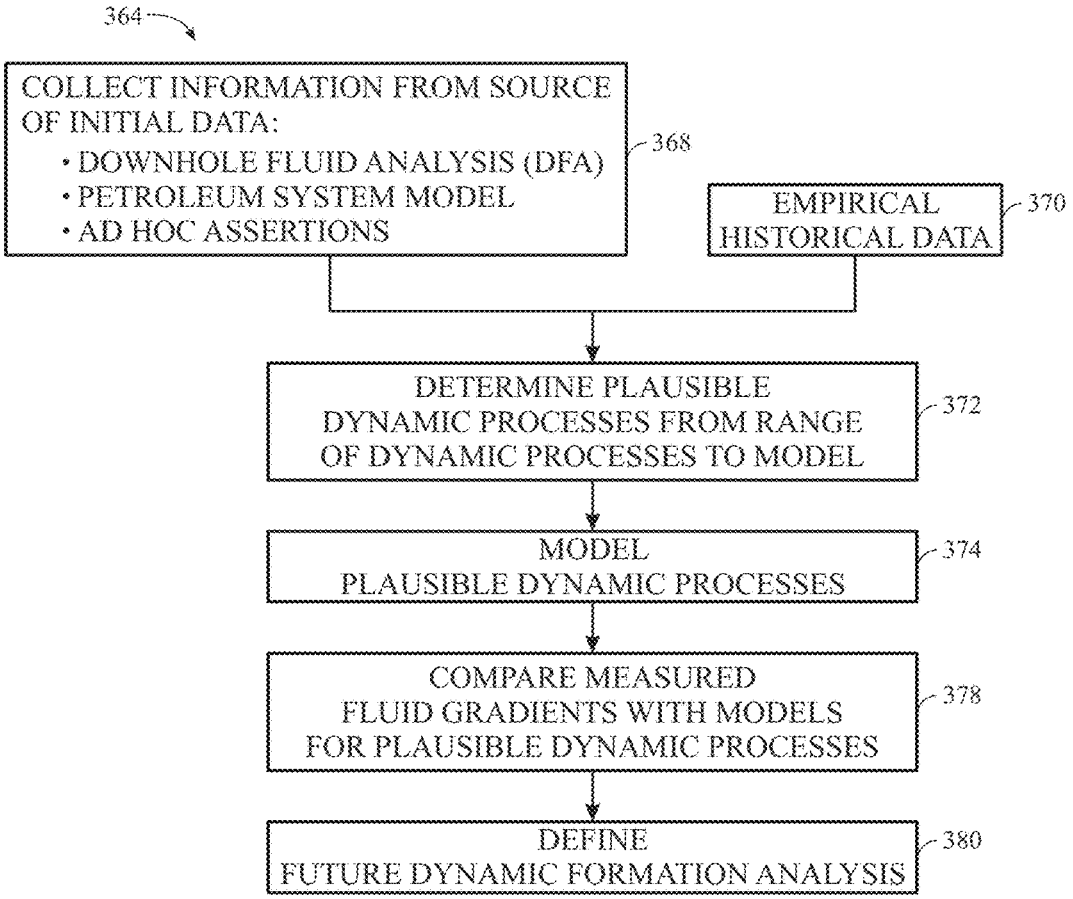
FIG. 12 is a flow diagram of a method that may be used to develop the fluid geodynamic model according a method in accordance with an embodiment of the present techniques.

Returning to the method 300 of FIG. 11, once the initial downhole fluid analysis (DFA) has been performed according to the acts of block 308, the method includes developing a fluid geodynamic model based on the initial DFA data to generate a gross-scale reservoir architecture (block 360). The fluid geodynamic model may receive information associated with the behavior of the reservoir fluid 50 in the formation 20. FIG. 12 is a flow chart of a method 364 that may be used to develop the fluid geodynamic model according to block 360 of the method 300. In the illustrated flowchart 364, information from sources of initial data is collected (block 368). The sources of the initial data may include the data 70 (e.g., from the initial downhole DFA according to block 308 of the method 300), data from petroleum systems modeling (PSM), ad hoc assertions from operators, seismic data, logging data, or any other suitable source of information associated with the reservoir 8. In addition to the data obtained according to block 368, the method 364 also includes obtaining empirical historical data (e.g., case study data) generated over time from the reservoir 8 and/or other reservoirs having fluid behaviors similar to the reservoir 8 (block 370).

As discussed above, the data 70 from the DFA may provide information regarding the gas-to-oil ratio (GOR), viscosity, density, composition (e.g., asphaltene content), and combinations thereof of the reservoir fluid 50 at different depths (e.g., the depth) of the reservoir 8. The data 70 may be compared to routine sequence and behavior information associated with the reservoir 8 that may be obtained from PSM, the operator, and empirical historical data 370. Any changes in the measured data 70 and/or reservoir productivity from the routine sequence and behavior may indicate to the operator that the reservoir 8 may be in disequilibrium and/or one or more realization scenarios have or are currently occurring. The DFA information generated from the data 70 may identify one or more gradients (e.g., viscosity gradients, density gradients, GOR gradients, asphaltene concentration gradients, etc.) in the reservoir fluid 50 that may be associated with one or more realization scenarios (e.g., the dynamic process discussed above). Once the one or more gradients have been identified, the empirical historical data from block 370 may be used to determine one or more plausible scenarios from a range of realization scenarios (block 372) that may be causing the one or more gradients.

Following identification of the one or more gradients, the method 364 includes modeling the one or more plausible realization scenarios (block 374). Each plausible realization scenario from the one or more plausible realization scenarios, identified according to block 372, may be modeled using the respective equilibrium and/or dynamic equation of state (EOS) models. By way of example, if biodegradation was identified as one of the plausible realization scenarios, the equilibrium and dynamic EOS model for biodegradation is used to model the realization scenario. Having identified the one or more plausible realization scenarios according to block 372 may increase the robustness of the method 364 compared to modeling each realization scenario from the range of realization scenarios that may or may not be affecting the reservoir 8.

The method 364 also includes comparing the measured fluid gradients (e.g., obtained from the data 70) with the EOS models (e.g., from block 374) for the one or more plausible realization scenarios (block 378). By comparing (e.g., fitting) the measured fluid gradients and the EOS models, the method 364 disclosed herein may determine if the reservoir 8 is in equilibrium or disequilibrium, and may predict the one or more realization scenario causing the gradients based on the realization scenario EOS model that fits the data 70 from block 368. For example, if the measured fluid gradient fits the equilibrium EOS, the data processing system 76 may determine that the reservoir 8 is in equilibrium. Conversely, if the measured fluid gradient fits the dynamic EOS, the data processing system 76 may determine that the reservoir 8 is in disequilibrium. Similarly, if the measured fluid gradient fits the EOS model for a respective realization scenario (e.g., gas diffusion, biodegradation, pressure driven oil or gas flows, etc.), the data processing system 76 may predict that the observed fluid gradient is a result of the realization scenario associated with that particular EOS model. As should be noted, the EOS models may be compared to data from other sources. For example, the EOS models may be compared to the petroleum system models for the reservoir 8, ad hoc assertions from the operator, or combinations thereof.

In certain embodiments, the one or more realization scenarios concluded, according to the acts of block 378, may be validated via geochemical analyses. The geochemical analyses may include measuring biomarker ratios known to be sensitive to identified realization scenarios. The biomarker ratios may be measured with single- or multi-dimensional gas chromatography or any other suitable analytical technique. Additionally, the geochemical analysis may include measuring asphaltene composition, which may also be used to determine certain parameters in the equation of state (EOS) models.

The combination of the data 70 from the downhole fluid analysis (DFA) and the EOS models may also provide information as to where in the reservoir 8 the identified one or more realization scenarios are located. For example, the depth at which the measured asphaltene content (e.g., determined via DFA) of the reservoir fluid 50 increases more than predicted by the equilibrium EOS may be the depth at which the viscosity of the reservoir fluid 50 increases precipitously, and the location where a biodegradation realization scenario is likely occurring. Similarly, gas diffusion (e.g., continuous or discontinuous) may result in various fluid gradients (e.g., GOR, bubble point, gravity, and asphaltene onset pressure) that may affect reservoir productivity. The location of the gas diffusion may be located at depths where the gas content (e.g., GOR determined from DFA) is higher and the asphaltene content (e.g., measured using DFA) is lower than predicted by the equilibrium EOS. As described in further detail below, knowing the location of the realization scenarios may facilitate oil recovery and reservoir production operations.

Once the one or more realization scenarios for the measured fluid gradients have been determined, the information obtained from the acts of blocks 368, 370, 372, 374, and 378 may be used to define future dynamic formation analysis (block 380). Information associated with the type and location of the realization scenario may be used as input parameters for the dynamic formation analysis. The dynamic formation analysis may then be used to investigate future logging campaigns, models in reservoir simulators, models in reservoir simulators, and petroleum system modeling. Additionally, the identified realization scenarios may suggest potential issues, and the location of the potential issues, within the reservoir 8 that may impact reservoir productivity. As such, an operator may plan where and how to implement reservoir drilling operations that may recover a desirable amount of hydrocarbons (e.g., the reservoir fluid) from the reservoir 8, and plan surface facility design. Moreover, the realization scenarios predicted, according to block 378, may be used to determine enhanced oil recovery (EOR) techniques to increase productivity of the reservoir 8 that may be affected by the realization scenario. For example, in the case of a gas diffusion realization scenario, an operator may manage the gas diffusion by keeping fluid pressure above a saturation pressure of the gas. The operator may also design the facilities at surface to accommodate the volume of gas that may be produced as a result of the gas diffusion. If the realization scenario indicates the presence of bitumen deposits upstructure, the operator may use organic scale treatments (e.g., xylene washes) to improve the reservoir productivity during reservoir development operations and/or EOR. Therefore, the data processing system 76 may use the information generated from the acts of the method 364 to predict the realization scenarios occurring within the reservoir 8 and identify potential issues, and their location, that may impact reservoir productivity for wellbores within the reservoir 8 and/or other reservoirs having fluid behaviors similar to that of reservoir 8.

The predicted realization scenarios within the reservoir 8 may be used to plan logging measurements that are used to characterize reservoirs and mitigate potential problems that may be associated with the reservoirs. By way of example, the information obtained from the predicted realization scenarios may provide information as to where potential problems may occur within the reservoir 8. As such, the operator may plan where in the reservoir 8 logging measurements are acquired. The logging measurements may also be used to validate the prediction of the realization scenarios. For example, the logging measurements may be fitted to the predicted realization scenarios. In certain embodiments, lab data for the reservoir 8 may be compared to the predicted realization scenario to validate and determine the accuracy of the predicted realization scenario generated from the acts of the method 364. Furthermore, the dynamic EOS models for the predicted realization scenarios may be used in the formation analyses to collect data from other reservoirs and/or wellbores within the reservoir 8 in a way that may increase the accuracy of the realization scenarios identified.

Returning to FIG. 11, following development of the fluid geodynamic model to obtain gross-scale reservoir architecture according to the acts of block 360, the method 300 includes refining the fluid geodynamic model using the well logs (e.g., from block 304) to generate a fine-scale reservoir architecture (block 384). For example, borehole imaging logs may be provided as input parameters for the fluid geodynamic model of block 360 to identify depositional environments, channel (e.g., the channels 252), sheets (e.g., the sheets 250), leveed channels (e.g., the leveed channels 256), reservoir connectivity, reservoir age, among others. By providing information from the borehole imaging logs, the fluid geodynamic model may approximate when the reservoir 8 may reach equilibrium in geological time.

For example, the refined fluid geodynamic model from block 384 may enable identification of continuous fluid columns in thermodynamic equilibrium and geological continuity (e.g., vertical fractures/depositional system elements) with a suitable degree of accuracy compared to techniques that do not use a model that receives input parameters from both DFA and borehole imaging logs. In addition, the refined fluid geodynamics model may identify continuous fluid column that are not in thermodynamic equilibrium (e.g., are in disequilibrium) due to, for example, impermeable layers (e.g., the impermeable region) and/or fractures in the reservoir 8. Other reservoir features that may be identified by the fluid geodynamic model include discontinuous fluid columns resulting from flow barriers (e.g., the impermeable region) that are in thermodynamic equilibrium or disequilibrium. The borehole imaging logs may provide an input parameter to the fluid geodynamic model that may estimate lateral dimensions of the discontinuous fluid column. For example, the fluid geodynamic model may receive information associated with the depositional system and/or location of the depositional system within the architecture of the reservoir. In certain embodiments, the fluid geodynamic model may also receive reservoir architectural information generated from a geological process model (GPM). In this way, fine scale well logging information (e.g., the borehole images) may be used to accurately identify the fine-scale reservoir architecture. Knowing the fine-scale reservoir architecture may facilitate reservoir planning and development such that the operator may optimize hydrocarbon extraction. As such, costs associated with exploratory drilling operations, which may result in non-producing wells due to a lack of reservoir architecture information, may be decreased.

The refined fluid geodynamic model may be validated by comparing the model data with known reservoir properties (e.g., obtained from seismic, core sample analysis, empirical historical data from other wells within the reservoir and/or nearby reservoirs) and/or comparing the model data with petroleum systems models (PSM). If the fluid geodynamic model data fits the know reservoir properties and/or the PSM, the fluid geodynamic model provided an accurate representation of the fine-scale reservoir architecture, and the reservoir is properly understood. However, if the fluid geodynamic model data does not fit the known reservoir properties and/or PSM, the fluid geodynamic model did not provide an accurate representation of the fine-scale reservoir architecture, and the reservoir is not properly understood. As such, additional logging and DFA data may be collected from the wellbore 14 and/or other wellbores within the reservoir 8 to continue refining the fluid geodynamic model.

In certain embodiments, the borehole imaging logs and the DFA data may be used to refine the geologic process model (GPM) and/or the equation of state (EOS) models used to determine the dynamic processes (e.g., realization scenarios) of the reservoir according to the acts of the method 364. This may facilitate estimating reservoir formation and fluid characteristics in other spatial locations within the reservoir 8.

Figure 13:
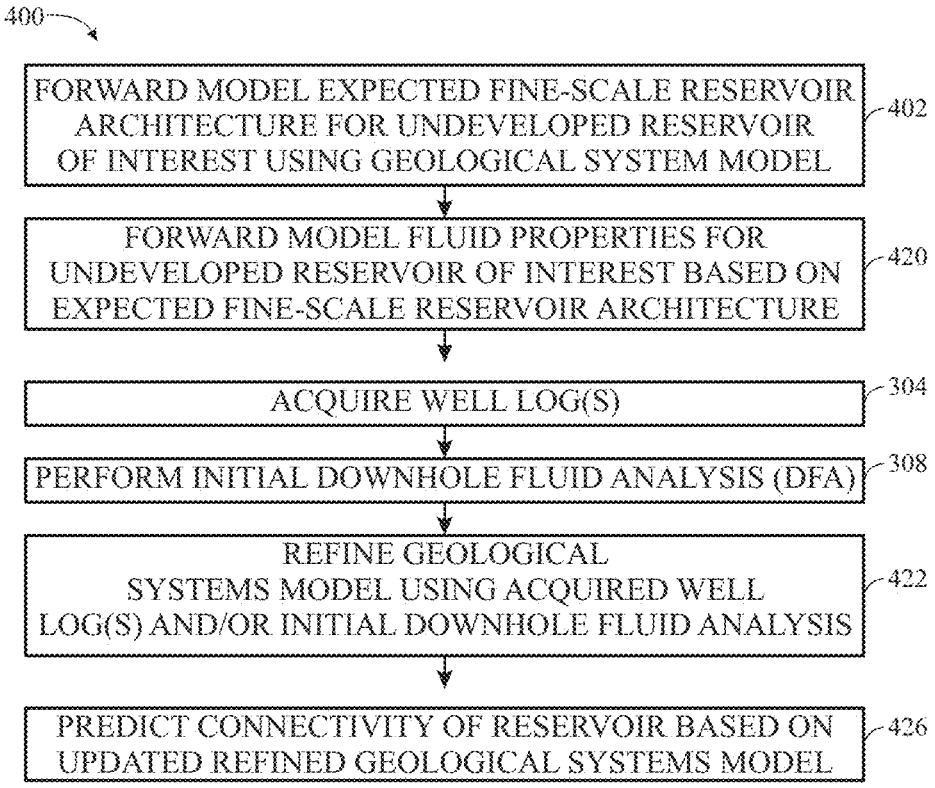
FIG. 13 is a flow diagram of a method that may be used to estimate the fine-scale reservoir architecture of the reservoir, in accordance with an embodiment of the present techniques.
Figure 14:
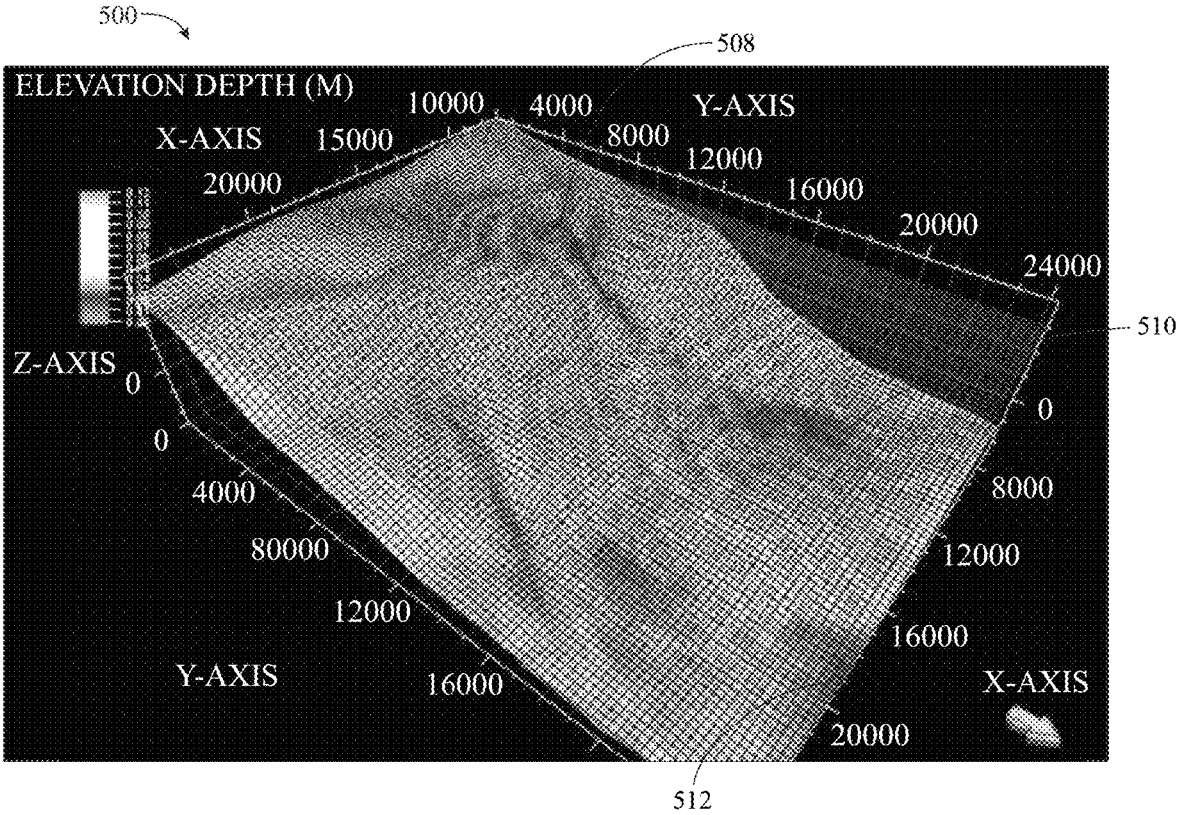
FIG. 14 illustrates a representative reservoir simulation generated, in accordance with an embodiment of the present techniques.
Figure 15:
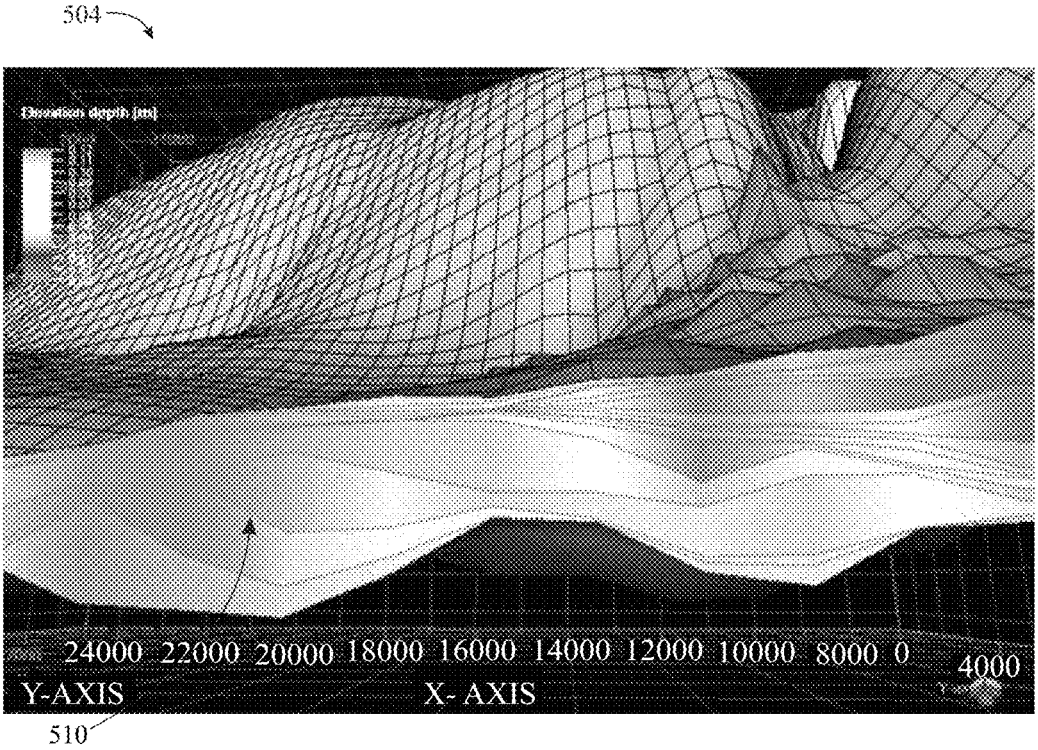
FIG. 15 illustrates a representative reservoir simulation generated, in accordance with an embodiment of the present techniques.

In an alternative embodiment, the fine-scale reservoir architecture is estimated before drilling into the reservoir. For example, FIG. 13 is a flow diagram of a method 400 that may be used to estimate (e.g., predict) the fine-scale reservoir architecture of the reservoir. The method 400 includes forward modeling expected fine-scale reservoir architecture of an undeveloped reservoir of interest using the geological process model (GPM) (block 402). The undeveloped reservoir may include depositional environments such as, for example, sedimentary facies, metamorphic, turbidite fans, shale facies, channel sand, levee, marine siltstone, other suitable depositional environments, and combinations thereof. The GPM may receive input parameters from seismic data, empirical historical data, or any other suitable data collected and/or modeled prior to drilling into the undeveloped reservoir of interest. FIGS. 14 and 15 illustrate a representative reservoir simulation 500 generated according to the acts of block 402. As shown in FIGS. 14 and 15, the model 500 illustrates depositional elements corresponding to, for example, a deepwater system. The depositional elements in the deepwater system include a shelf edge 508, a turbidite fan 510, and slump system 512. In the illustrated embodiment, the turbidite fan 510 is at a center of the reservoir simulation 504 and the slump 512 is at a lower corner of the reservoir simulation 504. As should be noted, the simulation 504 represents the top 10 meters of a sequence at a coarse scale. However, the sequence may be further defined to cover several hundred meters with greater detail. FIG. 10 is an exploded view of the simulation 504 illustrating the turbidite fan 510.

In addition to modeling the fine-scale reservoir architecture, the method 400 of FIG. 13 includes forward modeling reservoir fluid properties for the undeveloped reservoir of interest based on expected fine-scale reservoir architecture (block 420). The reservoir fluid properties may be forward modeled using information from wellbores in reservoirs similar to the undeveloped reservoir of interest. Following the forward modeling of the fine-scale reservoir architecture and reservoir fluid properties according to the acts of blocks 402, 420, respectively, the method 400 includes drilling a wellbore into the reservoir and acquiring well logs (block 304) and performing the initial downhole fluid analysis (DFA) (block 308), as discussed above with reference to FIG. 11. The method also includes refining the geological process model (GPM) based on acquired well logs and/or the initial DFA (block 422). For example, in certain embodiments, the well logs may be used to refine the GPM model such that a location (e.g., along the wellbore depth) of the initial DFA may be optimized. That is, the initial DFA is performed in an area of the reservoir that has hydrocarbons (e.g., the reservoir fluid 50). The data from the initial DFA may also be used to further refine the refined GPM. For example, DFA data may include information associated with the reservoir quality, vertical connectivity of the reservoir, etc., which are relevant elements within the reservoir that enable an operator to understand the fine-scale reservoir architecture. The method also includes using the refined GPM to predict lateral connectivity of the reservoir (block 426).

As discussed above, reservoir fluid geodynamics from the downhole fluid analysis (DFA) and borehole logging information may be used to model dynamic fluid behaviors and reservoir depositional characteristics to provide accurate and reliable information associated with the fine-scale architecture of a reservoir of interest. For example, the DFA and logging information (e.g., borehole imaging data) may provide information associated with hydrocarbon timing (e.g., age), type (e.g., light oil, heavy oil), fluid distributions (e.g., gradients), volume of the reservoir fluid, permeable and/or non-permeable regions, faults, fractures, 3D orientation of strata traversing the wellbore, and so forth. This information may be used to identify and locate realization scenarios (e.g., dynamic processes) and reservoir geometries that may affect reservoir productivity. By knowing the fine-scale reservoir architecture (e.g., dynamic fluid processes and reservoir geometries), operators may better assess the economic value of the reservoir, obtain reservoir development plans, and identify hydrocarbon production concerns for the reservoir.

Moreover, the information from the fine-scale reservoir architecture may be used to develop future reservoirs.

As may be appreciated, the above techniques for identifying and generating information pertaining to reservoir architecture may be used to identify areas of low permeability, such as by identifying the presence of baffles, shale, or other obstructions that may reduce flow. In other words, baffles are low permeability flow barriers that restrict the flow of fluids in a reservoir. The presence of baffles may be challenging to identify by pressure or seismic surveys. As described herein, a method 600 of log analysis may help identify the presence and location of baffles.

A principle well log is involved in DFA, which provides measurements of spatial gradients in fluid composition such as asphaltene content. Other techniques such as NMR logging and core analysis may be optionally integrated. Baffles 620 (see FIG. 18) are identified in downhole fluid analysis by their impact in the magnitude of the fluid gradient. Reservoirs without baffles 620 have relatively fast fluid movement, enabling the fluids to establish thermodynamic equilibrium in a certain period of time. Reservoir with the baffles 620 have relatively slow fluid movement, preventing the fluids from establishing thermodynamics equilibrium within the same period of time. Measured fluid gradients are compared with realizations of modeled fluid gradients with and without baffles 620 to identify the presence and location of baffles 620. As described above, spatial variations (i.e. gradients) in the composition of reservoir fluids are routinely measured with DFA tools, which may be analyzed with various EOS.

Figure 16:
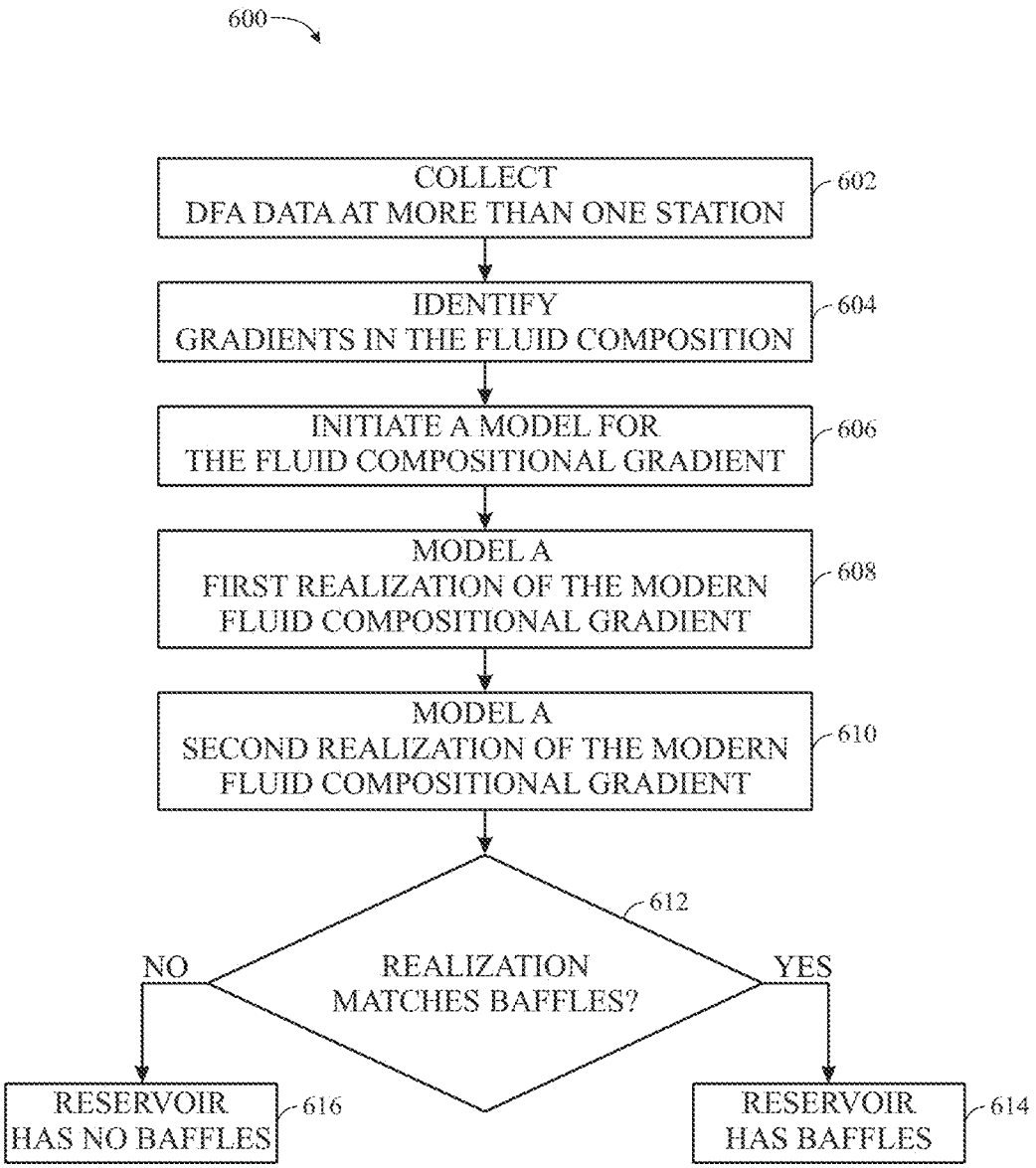
FIG. 16 is a flow diagram of a method of log analysis to identify the presence and location of baffles, in accordance with an embodiment of the present techniques.

FIG. 16 is a flow diagram of a method 600 of log analysis to identify the presence and location of baffles 620. The method 600 includes collecting DFA data at more than one station (block 602). Measurements are made with a tool such as the IFA based on a filter or grating visible-near infrared spectrometer. Quantities measured include GOR and asphaltene content. In some embodiments, density and viscosity are also measured. The method 600 includes identifying gradients in the fluid composition (block 604). As described above, the gradients identify variation in GOR and asphaltene content with true vertical depth. Gradients in horizontal wells and between wells may also be observed. The method 600 includes initiating a model for the fluid compositional gradient (block 606). In some embodiments, the model may be a petroleum system model. The model may use an estimate of the timing of the fluid charge, an estimate of the magnitude of the gradient resulting from the initial charge, or a combination thereof. The magnitude of the initial gradient could depend for example the charge multiple. The charge multiple is ratio of the volume of oil the migrated into the reservoir rock over the total pore volume of the reservoir rock. Reservoirs with larger charge multiples are expected to have smaller initial gradients. The method 600 includes modeling a first realization of the modern fluid compositional gradient (block 608). Starting from the initial gradient, this models how the fluid compositional gradient would evolve since the fluid is charged. The evolution is likely dominated by diffusion within the reservoir. In some instances, such as a late light charge, fluid density inversion may appear, and a convective model may be used. The model includes the impacts of gravity, solubility, and entropy, as described by the FHZ EOS. This first realization will consider a reservoir containing one or more baffles 620. The baffles 620 will retard fluid movement, causing the modeled modern gradient to be relatively similar to the gradient resulting from the initial charge. Optionally, multiple versions of the first realization could be run, exploring different numbers, types, and locations of baffles 620.

The method 600 includes modeling a second realization of the modern fluid compositional gradient (block 610). This realization will be similar to the first realization, except in this realization there are no baffles 620 present in the reservoir. As the result, this modeled modern gradient will be relatively different from the gradient resulting from the initial charge. The method 600 includes comparing both realizations to the measured fluid gradient (block 612). If the realization including the baffles 620 matches the measured gradient, an interpretation is made that the reservoir contains baffles (block 614). If the realization omitting the baffles 620 matches the measured gradient, an interpretation is made that the reservoir does not contain baffles (block 616).

In some embodiments, the fluid gradient assessment of baffles may be integrated with an independent assessment of the baffles 620 from interval pressure transient testing (IPTT). The results of the fluid gradient analysis could be used to identify candidate locations for IPTT analysis. In some embodiments, the assessment of baffles may be integrated with an independent assessment of baffles from petrophysical logging. Petrophysical logs investigate the reservoir the near wellbore region, which may suggest the presence of baffles more extensively in the reservoir. The petrophysical analysis could include NMR logging. The petrophysical logging could be used to identify candidate locations for fluid gradient analysis, or vice versa.

In some embodiments, the assessment of baffles may be integrated with an independent assessment of baffles from core analysis. Core analysis investigates the near wellbore region, which may suggest the presence of fluid obstructions (e.g., the baffles 620) more extensively in the reservoir. The core analysis could include analysis of deformation bands, where low permeability baffles appear as powderized rock layers. This analysis and the other analyses could be used to identify candidate locations for each other.

In some embodiments, the assessment of baffles may be integrated with an independent assessment of baffles from geologic analysis. The geologic analysis could include analysis of faults, stress, tilt and could involve the depositional setting such as distal sheet sands that can contain shales breaks that act as baffles. The current reservoir setting could include distortion of original sediments such as deformation bands that occur as a result of stress and strain post deposition. These reservoir settings can yield baffling.

Figure 19:
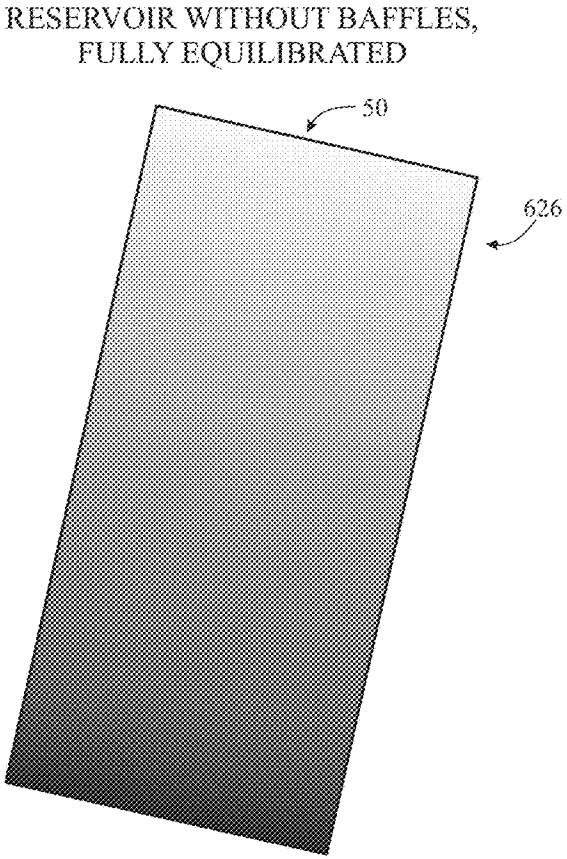
FIG. 19 illustrates a realization without baffles depicting a larger increase in the magnitude of the fluid gradient, in accordance with an embodiment of the present techniques.
Figure 18:
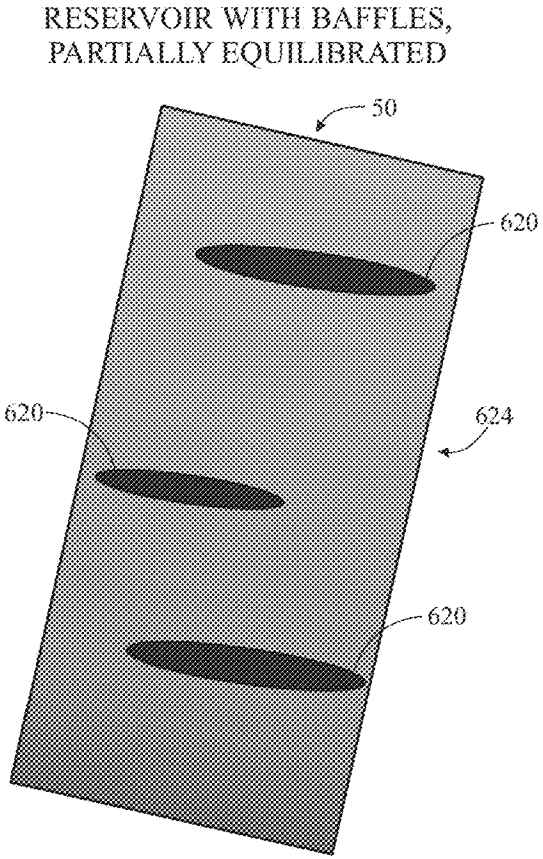
FIG. 18 illustrates a realization with baffles depicting a small increase in the magnitude of the fluid gradient, in accordance with an embodiment of the present techniques.
Figure 17:
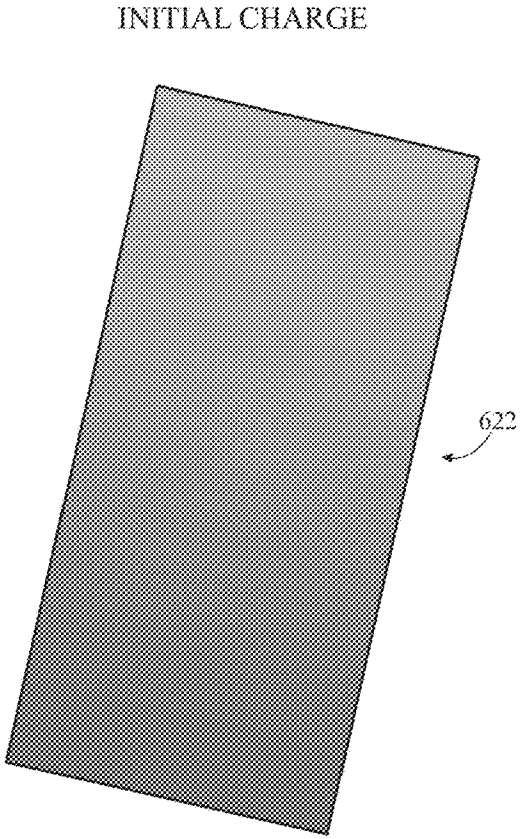
FIG. 17 illustrates an initial model that contains an increase in asphaltenes at greater reservoir depth, in accordance with an embodiment of the present techniques.

FIGS. 17-19 illustrate various depictions of reservoirs illustrating the differences between reservoirs with baffles and without the baffles 620. With knowledge of the formation tops (e.g., from logs) and the charge multiples (e.g., from the petroleum system model), and initial model of the fluid gradient (as shown by arrow 622) in asphaltene content resulting from the fluid charge is created. The initial model will contain an increase in asphaltenes at greater reservoir depth, resulting from the presence of less mature, higher asphaltene content oil at greater depths. This initial model is depicted in FIG. 17, where darker shading indicate greater asphaltene content.

With knowledge of the time since filling (e.g., from the petroleum system model), two realizations of the modern asphaltene gradient can be created. In both realizations, the total amount of asphaltenes in the reservoir is unchanged from the initial state. However, the distribution of asphaltenes within the reservoir varies. In this example, the initial gradient is less steep than the equilibrium gradient (e.g., due to a large number of charge multiples or the presence of asphaltenes in the form of clusters). FIG. 18 depicts an example of the realization with the baffles 620, showing the magnitude of the fluid gradient (as shown by arrow 624) has increased, but by a relatively small amount. The fluids have not yet reached equilibrium, so the gradient cannot be successfully modeled with the FHZ equation, at least not when constrained to an allowed asphaltene particle size. FIG. 19 depicts an example of the realization without the baffles 620. Here, the magnitude of the fluid gradient has increased by a larger amount. The fluids have reached equilibrium, and the gradient (as shown by arrow 626) is successfully modeled with the FHZ equation using an allowed asphaltene particle size.

In this example, multiple DFA measurements are made over a laterally and vertically extensive region. The measured fluid gradients are then compared with the different realizations of the modeled modern gradient. If the measurements match the realization including baffles, the presence of baffles is suggested. If the measurements match the realization omitting baffles, the absence of baffles is suggested.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method comprising:

receiving first fluid property data from a first location in a hydrocarbon reservoir;

receiving second fluid property data from a second location in the hydrocarbon reservoir, wherein the first and second fluid property data is measured using a downhole acquisition tool;

performing, using a processor, a plurality of realizations of models of the hydrocarbon reservoir according to a respective plurality of dynamic processes to generate one or more respective modeled fluid properties, wherein the plurality of dynamic processes comprises a range of possible dynamic processes occurring within the hydrocarbon reservoir;

selecting, using the processor, one or more dynamic processes of the plurality of dynamic processes that is more likely to be occurring within the hydrocarbon reservoir compared to other dynamic processes in the plurality of dynamic processes based at least in part on a relationship between the first fluid property data, the second fluid property data, and the modeled fluid properties obtained from the realizations to identify potential disequilibrium in the hydrocarbon reservoir; and identifying, using the processor, disequilibrium in the hydrocarbon reservoir resulting from the selected one or more dynamic processes, wherein identifying the disequilibrium occurs after selecting the one or more dynamic processes of the plurality of dynamic processes.

2. The method of claim 1, comprising identifying, using the processor, a first fluid gradient from the first and second fluid property data.

3. The method of claim 2, wherein selecting the one or more plausible dynamic processes comprises establishing a relationship between the first fluid gradient and the modeled fluid properties obtained from one of the realizations modeled according to the one or more plausible dynamic processes that is selected.

4. The method of claim 2, wherein the first fluid gradient comprises a gas-to-oil ratio gradient, a viscosity gradient, a gravity gradient, a density gradient, an asphaltene content gradient, or any combination thereof.

5. The method of claim 2, comprising selecting, using the processor, at least one realization scenario from among the range of dynamic processes that is more likely to be causing the disequilibrium in the hydrocarbon reservoir compared to other realization scenarios in the range of dynamic processes based on a relationship between the one or more modeled fluid properties and the first fluid gradient.

6. The method of claim 5, wherein selecting the at least one realization scenario comprises determining a relationship between the first fluid gradient of the first fluid property data and the modeled fluid gradient.

7. The method of claim 5, comprising predicting, using the processor, a location within the hydrocarbon reservoir where the one or more dynamic processes takes place based at least in part on the modeling of the hydrocarbon reservoir according to the at least one likely realization scenario.

8. The method of claim 5, wherein selecting the at least one realization scenario comprises determining number of fluid obstructions, a location of fluid obstructions, or a combination thereof.

9. The method of claim 8, wherein the location comprises a depth of the wellbore.

10. The method of claim 1, comprising operating the downhole acquisition tool in the hydrocarbon reservoir to measure the first fluid property data of the hydrocarbon reservoir.

11. The method of claim 1, comprising determining, using the processor, an enhanced oil recovery technique, pressure maintenance, or both, based on the one or more plausible dynamic process.

12. The method of claim 1, wherein modeling the hydrocarbon reservoir comprises modeling fluid of the hydrocarbon reservoir according to an equation of state, wherein the equation of state comprises a diffusive model or a convective model associated with each respective realization scenario of the one or more plausible dynamic processes.

13. The method of claim 1, wherein the plurality of dynamic processes comprises hydrocarbon biodegradation, gas diffusion, fault block migration, or subsidence, or any combination thereof.

* * * * *